US006499395B2

(12) United States Patent
Aoyama et al.

(10) Patent No.: US 6,499,395 B2
(45) Date of Patent: Dec. 31, 2002

(54) OFFSET PRINTING MACHINE WITH IMPRESSION CYLINDER GRIPPER AND SHEET FEED CYLINDER GRIPPER

(75) Inventors: Hideo Aoyama, Fuchu (JP); Dong Liang, Fuchu (JP); Yoshiyuki Tsuji, Fuchu (JP)

(73) Assignee: Ryobi Ltd., Hiroshima-ken (JP)

( * ) Notice: Subject to any disclaimer, the term of this patent is extended or adjusted under 35 U.S.C. 154(b) by 0 days.

(21) Appl. No.: 09/749,751

(22) Filed: Dec. 28, 2000

(65) Prior Publication Data

US 2001/0004867 A1 Jun. 28, 2001

(30) Foreign Application Priority Data

Dec. 28, 1999 (JP) ..... 11-377211

(51) Int. Cl.[7] ..... B41F 7/10

(52) U.S. Cl. ..... 101/142; 101/177; 101/217; 101/232; 101/246

(58) Field of Search ..... 101/136, 137, 101/142, 177, 217, 232, 246, 409

(56) References Cited

U.S. PATENT DOCUMENTS 4,836,103 A * 6/1989 Komori et al. ..... 101/231
5,469,787 A * 11/1995 Turner et al. ..... 101/136
6,050,188 A * 4/2000 Bolza-Schunemann ..... 101/183

FOREIGN PATENT DOCUMENTS

| | | | |
|---|---|---|---|
| DE | 195 23 378 A1 | 6/1995 | |
| DE | 19822892 A1 * | 11/1999 | ..... B41F/7/02 |
| EP | 132800 A2 * | 2/1985 | ..... B41F/7/10 |
| JP | 60064849 A * | 4/1985 | ..... B41F/7/10 |
| JP | 9-510410 | 10/1997 | ..... B41F/7/10 |

* cited by examiner

*Primary Examiner*—Daniel J. Colilla
(74) *Attorney, Agent, or Firm*—Sughrue Mion, PLLC

(57) ABSTRACT

An offset printing machine including an impression cylinder, a sheet feed cylinder and a blanket cylinder. An outer peripheral surface of the blanket cylinder is divided into a plurality of color sections in a circumferential direction thereof, and an outer peripheral surface of the sheet feed cylinder has a peripheral length equal to the circumferential length of each color section. A sheet held in the sheet feed cylinder is transferred to the impression cylinder each time the sheet feed cylinder rotates a predetermined number equal to the number of the color sections. One of impression cylinder grippers and a sheet feed cylinder gripper intermittently confront with each other upon rotation of these cylinders. The sheet feed cylinder gripper is moved away from the impression cylinder gripper at the confrontation timing when a sheet is held on the impression cylinder by the impression cylinder gripper, so that any damage to the sheet held on the impression cylinder by the sheet feed cylinder gripper is avoidable.

11 Claims, 9 Drawing Sheets

OFFSET PRINTING MACHINE WITH IMPRESSION CYLINDER GRIPPER AND SHEET FEED CYLINDER GRIPPER

BACKGROUND OF THE INVENTION

The present invention relates to an offset printing machine, and more particularly, to sheet transfer from a sheet feed cylinder to an impression cylinder and from the impression cylinder to a sheet discharge portion.

Multiple color offset printing machines are known for printing in multiple colors. For example, Japanese Patent Application Publication Toku-Hyou-Hei-9-510410 discloses a four color offset printing machine in which a single impression cylinder, a single sheet discharge mechanism, a single sheet feed conveyor (feeder), a single sheet feed cylinder (sheet transfer cylinder), two blanket cylinders, two plate cylinders, and ink roller groups for four colors are provided.

A sheet feed mechanism including the sheet feed conveyor and the sheet feed cylinder is adapted for supplying a sheet to a surface of the impression cylinder. The impression cylinder has an outer peripheral surface where the sheet is held. The sheet discharge mechanism is adapted to remove the sheet from the surface of the impression cylinder. The blanket cylinders are adapted to press the sheet against the impression cylinder to form an ink image on the sheet.

The outer peripheral surface of the impression cylinder is provided with grippers, each gripper having a pawl at its tip for holding a sheet. The impression cylinder is equally divided into three segments for holding each sheet at each segment, and is driven by a drive motor. Axes of the blanket cylinders and the paper feed cylinder are disposed in parallel with the axis of the impression cylinder, and outer peripheral surfaces of the blanket cylinders and the paper feed cylinder are in contact with the outer peripheral surface of the impression cylinder. The blanket cylinders, the sheet feed conveyer, the sheet feed cylinder, and the sheet discharge mechanism are driven by rotation of the impression cylinder.

Each plate cylinder is formed with a plate at its outer peripheral surface. The axes of the two plate cylinders are disposed in parallel with the axes of the two blanket cylinders, and each plate cylinder is in contact with a corresponding blanket cylinder, so that each plate cylinder is rotated by the rotation of the corresponding blanket cylinder. The outer peripheral surface of each plate cylinder is equally divided into two plate segments, and each plate segment has a peripheral length equal to that of each segment of the impression cylinder. Each plate segment is formed with a plate for one specific color, and a different color is associated with each plate. Therefore, a total of four plates for four different colors are formed in the two plate cylinders.

Each ink roller group is adapted for supplying ink to the plate on the plate cylinder. Two groups of ink rollers are provided for one plate cylinder so as to supply inks of two colors. Therefore, four groups of ink rollers are provided for supplying inks of four different colors. The ink rollers have axes in parallel with the axis of the plate cylinder, and are in contact with the plate cylinder. The ink rollers are rotated by the rotation of the plate cylinder.

In this way, in the offset printing machine capable of performing four color printing with the two blanket cylinders, each sheet is printed with two colors during each single rotation of the impression cylinder, and printing of the additional two colors is performed during the second rotation of the impression cylinder. That is, each sheet is held on the impression cylinder for two rotations thereof, and thereafter must be released from the impression cylinder by the sheet discharge mechanism. If each sheet is supplied to the impression cylinder at every single rotation of the impression cylinder, it becomes impossible to perform four color printing with respect to each sheet. To avoid this, a sheet is supplied to every other segment of the impression cylinder. For example, if a sheet is supplied to a first segment, then, a sheet is not supplied to a second segment, but a sheet is supplied to a third segment. The supplied sheet is held on the impression cylinder until completion of two rotations thereof and is then discharged from the impression cylinder by the sheet discharge mechanism.

No specific arrangement is proposed in the Japanese patent application publication No.Toku-Hyou-Hei 9-510410 for supplying a sheet to every other segment of the impression cylinder.

One conceivable arrangement is to design the outer peripheral length of the sheet feed cylinder equal to the peripheral length of each segment of the impression cylinder, and supply a sheet to the impression cylinder at every twice rotation of the sheet feed cylinder. However, when a sheet is transferred from the sheet feed cylinder to the impression cylinder, each time one of the impression cylinder pawls holding a sheet at an outer periphery of the impression cylinder intersects with sheet feed cylinder pawls for holding a sheet to the outer periphery of the sheet feed cylinder, a sheet cannot be maintained at the outer periphery of the impression cylinder for more than a single rotation of the impression cylinder.

Further, each of the impression cylinder pawls protrudes radially outwardly from the outer peripheral surface of the impression cylinder, and the sheet feed cylinder pawls protrude radially outwardly from the outer peripheral surface of the sheet feed cylinder. Also, recesses are formed in the section of the impression cylinder and the sheet feed cylinder that confronts the protruding pawls. Therefore, when the pawls of the sheet feed cylinder and the impression cylinder intersect without transferring a sheet, that is, for maintaining a sheet on the peripheral surface of the impression cylinder, the pawl provided to the sheet feed cylinder and protruding toward the corresponding recess on the impression cylinder pushes the sheet held on the impression cylinder, and possibly tears the sheet.

SUMMARY OF THE INVENTION

It is an object of the present invention to provide an offset printing machine capable of maintaining a sheet held on the impression cylinder without damaging the sheet by the pawl on the sheet feed cylinder when the pawl on the sheet feed cylinder relatively passes through the pawls on the impression cylinder and when there is no need to transfer a sheet from the sheet feed cylinder to the impression cylinder.

This and other objects of the present invention will be attained by an offset printing machine for forming an image on a sheet including a plate cylinder, a blanket cylinder, an impression cylinder, impression cylinder grippers, a sheet feed cylinder, a sheet feed cylinder gripper, an improved sheet feed side impression cylinder gripper drive mechanism, and an improved sheet feed cylinder gripper drive mechanism. The plate cylinder is rotatable about its axis and has an outer peripheral surface equally divided in a circumferential direction into at least two color regions. An ink image is formed on each color region and each color region has an equal circumferential length. The blanket cylinder is rotatable about its axis and has an outer peripheral surface in contact with the color regions and is equally divided in a circumferential direction into at least two color sections. Each ink image on each color region is transferred to each color section, and each color section has an equal circumferential length. The impression cylinder is rotatable about its axis and has an outer peripheral surface on which the sheet is held and transferred. Each color section is in contact with the outer peripheral surface of the impression cylinder for transferring each ink image on each color section onto the sheet. The outer peripheral surface of the impression cylinder is equally divided into a plurality of segments each having a peripheral length equal to the circumferential length of the color region and the color section. The impression cylinders are provided at the outer peripheral surface of the impression cylinder and are movable along with the rotation of the impression cylinder. Each impression cylinder gripper is positioned at each leading end portion of each segment, and each impression cylinder gripper is movable between an open position and a closed position. The sheet feed cylinder is rotatable about its axis and has an outer peripheral surface on which a sheet is held and transferred and in contact with the outer peripheral surface of the impression cylinder at a contact position for transferring the sheet to the impression cylinder. The outer peripheral surface of the sheet feed cylinder has a peripheral length equal to a peripheral length of each of the segments. The sheet feed cylinder gripper is provided at the outer peripheral surface of the sheet feed cylinder and is movable along with the rotation of the sheet feed cylinder. The sheet feed cylinder gripper and the impression cylinder gripper is so positioned to simultaneously reach the contact position. The sheet feed cylinder gripper is movable between an open position and a closed position. The sheet feed side impression cylinder gripper drive mechanism is adapted for moving the impression cylinder gripper to either its open position or closed position at the contact position. The sheet feed cylinder gripper drive mechanism is adapted for moving the sheet feed cylinder gripper to either its open position or closed position. A combination of the sheet feed side impression cylinder gripper drive mechanism and the sheet feed cylinder gripper drive mechanism includes means for providing a sheet transfer timing by switching the impression cylinder gripper from its open position to its closed position and by switching the sheet feed cylinder gripper from its closed position to its open position at a predetermined timing of confrontation between the impression cylinder gripper and the sheet feed cylinder gripper at the contact position. The predetermined confronting timing occurs when the confronting times is equal to the number of the color sections of the blanket cylinder. The sheet feed side impression cylinder gripper drive mechanism includes means for maintaining the closed position of the impression cylinder gripper when the impression cylinder gripper passes by the contact position but except the predetermined confronting timing. The sheet feed cylinder gripper drive mechanism includes means for maintaining the open position of the sheet feed cylinder gripper when the sheet feed cylinder gripper passes by the contact portion but except the predetermined confronting timing. A combination of the maintaining means of the sheet feed side impression cylinder gripper drive mechanism and the maintaining means of the sheet feed cylinder gripper drive mechanism constituting the providing means.

In another aspect of the invention, there is provided an offset printing machine for forming an image on a sheet including a frame, the plate cylinder, the blanket cylinder, the impression cylinder those supported on the frame, the impression cylinder gripper, the sheet feed cylinder, the sheet feed cylinder gripper, an improved sheet feed side impression cylinder gripper drive mechanism, and an improved sheet feed cylinder gripper drive mechanism. The sheet feed side impression cylinder gripper drive mechanism is adapted for moving the impression cylinder gripper to either its open position or closed position at the contact position. The sheet feed cylinder gripper drive mechanism is adapted for moving the sheet feed cylinder gripper to either its open position or closed position. The sheet feed side impression cylinder gripper drive mechanism includes a cam shaft, a first cam, a first grip switching cam, and a first link mechanism. The cam shaft is rotatably supported by the frame, and is rotated once each time the impression cylinder rotates a predetermined number which is the number of the color sections divided by the number of the segments. The first cam is provided integrally with the cam shaft and is rotatable together with the cam shaft. The first cam has a front half first cam surface area and a rear half second cam surface area. The first grip switching cam is supported to the frame and is movable between an abutment position and a non-abuttable position. In the abutment position, the first grip switching cam is abuttable on the impression cylinder gripper for moving the impression cylinder gripper from their closed position to their open position and then to the closed position when each one of the impression cylinder grippers passes by the contact position. In the non-abutment position, the grip switching cam is positioned spaced away from the impression cylinder grippers for maintaining the impression cylinder grippers to their closed position. The first link mechanism has one end in contact with the first cam and movable in accordance with a contour of the first cam, and has another end connected to the first grip switching cam for moving the first grip switching cam between the abutment position and the non-abutment position. The abutment position is provided by the contact of the one end with the first cam surface area, and the non-abutment position is provided by the contact of the one end with the second cam surface area. The sheet feed cylinder gripper drive mechanism includes a second cam, a second grip switching cam, a fixed cam, and a second link mechanism. The second cam is provided integrally with the cam shaft and is rotatable together with the cam shaft. The second cam has a front half cam surface area and a rear half cam surface area. The front half cam surface area is superposed with the second cam surface area of the first cam and the rear half cam surface area is superposed with the first cam surface area of the first cam. The second grip switching cam is supported to the frame and is movable between an abutment position abuttable on the sheet feed cylinder gripper for moving the sheet feed cylinder gripper from its closed position to its open position when the sheet feed cylinder gripper passes by the contact position and non-abutment position spaced away from the sheet feed cylinder gripper for maintaining the sheet feed cylinder gripper to its closed position. The fixed cam is fixed to the frame and is positioned downstream of the second grip switching cam with respect to a rotational direction of the sheet feed cylinder. The sheet feed cylinder gripper is abutable on the fixed cam for providing open position of the sheet feed cylinder gripper. The second link mechanism has one end in contact with the second cam and movable in accordance with a contour of the second cam, and has another end connected to the second grip switching cam for moving the second grip switching cam between the abutment position and the non-abutment position. The abutment position is provided by the contact of the one end with the rear half cam surface area, and the non-abutment position is provided by the contact of the one end with the front half cam surface area.

In still another aspect of the invention, there is provided an offset printing machine for forming an image on a sheet including the plate cylinder, the blanket cylinder, the impression cylinder, the impression cylinder grippers, a sheet discharge mechanism, an improved sheet discharge side impression cylinder gripper drive mechanism, and an improved sheet discharge gripper driving mechanism. The sheet discharge mechanism includes two sprockets, an endless chain, and at least two sheet discharge grippers. The two sprockets are rotatable about their axes extending in a direction parallel with the axis of the impression cylinder. The endless chain is mounted on the sprockets and is movable by the rotation of the sprockets. The at least two sheet discharge grippers are fixed to the endless chain and is equidistantly spaced away from each other. Each of the discharge grippers are movable between its open position for receiving and releasing a sheet and closed position for holding a sheet. The impression cylinder grippers and the discharge grippers provide a positional relationship that any one of the impression cylinder grippers reaches a discharge position between the impression cylinder and the sheet discharge mechanism when one of the sheet discharge grippers reaches the discharge position. The sheet discharge side impression cylinder gripper drive mechanism is adapted for moving each one of the impression cylinder grippers between its open position and closed position at the sheet discharge position. The sheet discharge gripper driving mechanism is adapted for moving each one of the sheet discharge grippers between its open position and closed position at the sheet discharge position. The sheet discharge side impression cylinder gripper drive mechanism includes means for maintaining the closed position of the impression cylinder gripper when the impression cylinder gripper passes by the sheet discharge position provided that any one of the sheet discharge grippers is positioned offset from the sheet discharge position. At least two sheet discharge grippers and the impression cylinder grippers provide a positional relationship so that one of the impression cylinder grippers is in confrontation with one of the sheet discharge grippers at a predetermined timing occurring at every predetermined number of access of any one of the impression cylinder grippers to the sheet discharge position. The predetermined number is equal to the number of color sections of the blanket cylinder.

In still another aspect of the invention, there is provided an offset printing machine for forming an image on a sheet including a frame, the plate cylinder, the blanket cylinder, the impression cylinder those supported on the frame, the impression cylinder grippers, the sheet discharge mechanism, and an improved sheet discharge side impression cylinder gripper drive mechanism, and an improved sheet discharge gripper driving mechanism. The sheet discharge side impression cylinder gripper drive mechanism is adapted for moving each one of the impression cylinder grippers between its open position and closed position at the sheet discharge position. The sheet discharge gripper driving mechanism is adapted for moving each one of the sheet discharge grippers between its open position and closed position at the sheet discharge position. The at least two sheet discharge grippers and the impression cylinder grippers provide a positional relationship so that one of the impression cylinder grippers is in confrontation with one of the sheet discharge grippers at a predetermined timing occurring at every predetermined number of access of any one of the impression cylinder grippers to the sheet discharge position. The predetermined number is equal to the number of color sections of the blanket cylinder. The sheet discharge side impression cylinder gripper drive mechanism includes a cam shaft, a cam member, a discharge grip switching cam, and a link mechanism. The cam shaft is rotatably supported by the frame, and is rotated once each time the impression cylinder rotates a predetermined number which is the number of the color sections divided by the number of the segments. The cam member is provided integrally with the cam shaft and is rotatable together with the cam shaft. The cam member has a front half first cam surface area and a rear half second cam surface area. The discharge grip switching cam is supported to the frame and is movable between an abutment position abuttable on the impression cylinder grippers for moving the impression cylinder grippers from their closed position to their open position when each one of the impression cylinder grippers passes by the sheet discharge position and non-abutment position spaced away from the impression cylinder grippers for maintaining the impression cylinder grippers to their closed position. The link mechanism has one end in contact with the cam member and movable in accordance with a contour of the cam member, and has another end connected to the discharge grip switching cam for moving the discharge grip switching cam between the abutment position and the non-abutment position. The abutment position is provided by the contact of the one end with the first cam surface area, and the non-abutment position is provided by the contact of the one end with the second cam surface area, whereby the closed position of the impression cylinder gripper is maintained when the impression cylinder gripper passes by the sheet discharge position provided that any one of the sheet discharge gripper is positioned offset from the sheet discharge position.

According to the above described offset printing machine, by the sheet feed side impression cylinder gripper drive mechanism and the sheet feed cylinder gripper drive mechanism, the impression cylinder gripper and the sheet feed cylinder gripper perform sheet transfer operation at a predetermined timing of confrontation between the impression cylinder gripper and the sheet feed cylinder gripper at the contact position. The confronting timing occurs when the confronting number is equal to the number of the color sections of the blanket cylinder. Except the predetermined confrontation timing but when the impression cylinder gripper and the sheet feed cylinder gripper reach the contact position, the impression cylinder gripper is maintained in its closed position as it pass by the contact position and the sheet feed cylinder gripper is maintained in its open position as they pass by the contact position. Accordingly, a sheet is transferred from the sheet feed cylinder to the impression cylinder only once each number of times the blanket cylinder is divided into color regions. When no sheet transfer is performed, the sheet feed cylinder grippers provided on the sheet feed cylinder will not damage the sheet held on the outer peripheral surface of the impression cylinder.

Further, according to the above described offset printing machine, the sheet discharge grippers are separated from each other along the length of the chain by a distance equal to the outer peripheral length of the blanket cylinder, and are positioned to meet with an impression cylinder gripper at the discharge position of a sheet to transfer the sheet from the impression cylinder gripper to the sheet discharge gripper. The sheet discharge is performed at a predetermined timing of confrontation between the impression cylinder gripper and the sheet discharge gripper at the sheet discharge position. The predetermined confrontation timing occurs at every predetermined number of access of the impression cylinder gripper to the discharge position, the predetermined number being equal to the number of color sections of the blanket cylinder. Accordingly, a sheet is transferred from the impression cylinder to the sheet discharge mechanism at the predetermined confrontation timing. When no sheet transfer is being performed, there is no danger that the sheet discharge grippers provided to the sheet discharge mechanism will damage the sheets supported on the outer peripheral surface of the impression cylinder.

DETAILED DESCRIPTION OF THE PREFERRED EMBODIMENTS

An offset printing machine according to one embodiment of the present invention will be described with reference to FIGS. 1 through 6.

(1) General Arrangement

Figure 1:
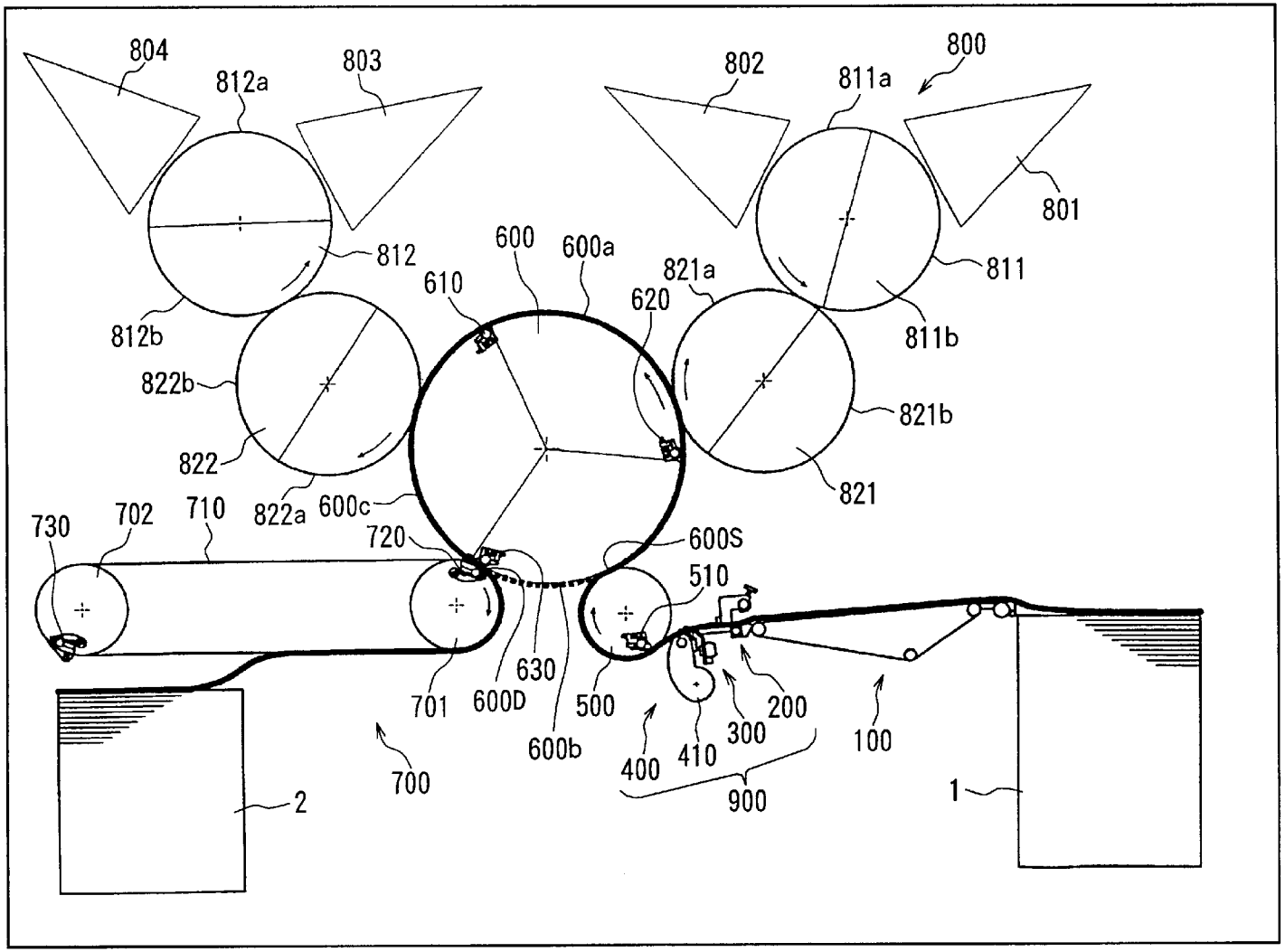
FIG. 1 is a schematic side view showing an offset printing machine according to an embodiment of the present invention.

First, a general arrangement of the offset printing machine will be described with reference to FIG. 1. The offset printing machine includes an ink section 800 including blanket cylinders 821, 822, plate cylinders 811, 812, and ink roller groups 801, 802, 803, 804 for printing ink images on a sheet held on an impression cylinder 600.

A sheet feed mechanism for feeding sheets, which serve as a print medium, to the impression cylinder 600 is disposed to one side of the impression cylinder 600. The sheet feed mechanism includes a sheet feed portion (sheet feed pile) 1, a feeder board 100, an infeed portion 900, and a sheet feed cylinder 500 for feeding a sheet stored in the sheet feed pile 1 to the impression cylinder 600. The infeed portion 900 includes a front lay mechanism 300 for abutting a leading edge of the sheets to temporarily prevent transport of sheets, a sheet lateral position control mechanism (a pull guide mechanism) 200 for adjusting position of the sheets in the widthwise direction, and a swing mechanism 400 for transferring sheets transported from the feeder board 100 to the sheet feed cylinder 500.

A sheet discharge mechanism 700 is disposed on the other side of the impression cylinder 600 than the sheet feed cylinder 500. The sheet discharge mechanism 700 is adapted for discharging printed sheets, which have received transfer of an ink image on the impression cylinder 600 from the ink section 800. The sheet discharge mechanism 700 includes sheet discharge sprockets 701, 702, an endless chain 710 mounted around the sheet discharge sprockets 701, 702, and sheet discharge grippers 720, 730 disposed on the chain 710. A sheet discharge pile 2 is provided adjacent to the sheet discharge mechanism 700 for accumulating printed sheets transported by the sheet discharge mechanism 700.

The sheet feed cylinder 500, the impression cylinder 600, the blanket cylinders 821, 822, and the plate cylinders 811, 812 have cylindrical shapes, and are rotatable about their axes extending in parallel with each other. Also, the two discharge sprockets 701, 702 of the sheet discharge mechanism 700 are also rotatable about their axes which extend in parallel with the sheet feed cylinder 500 and the like. The rotational directions of various components are indicated by arrows in FIG. 1. As shown in the drawings, the sheet feed cylinder 500, the sheet discharge sprocket 701 of the sheet discharge mechanism 700, and the blanket cylinders 821, 822 contact the outer peripheral surface of the impression cylinder 600, the plate cylinder 811 contacts the outer periphery of the blanket cylinder 821, and the plate cylinder 812 contacts the outer periphery of the blanket cylinder 822.

Figure 4:
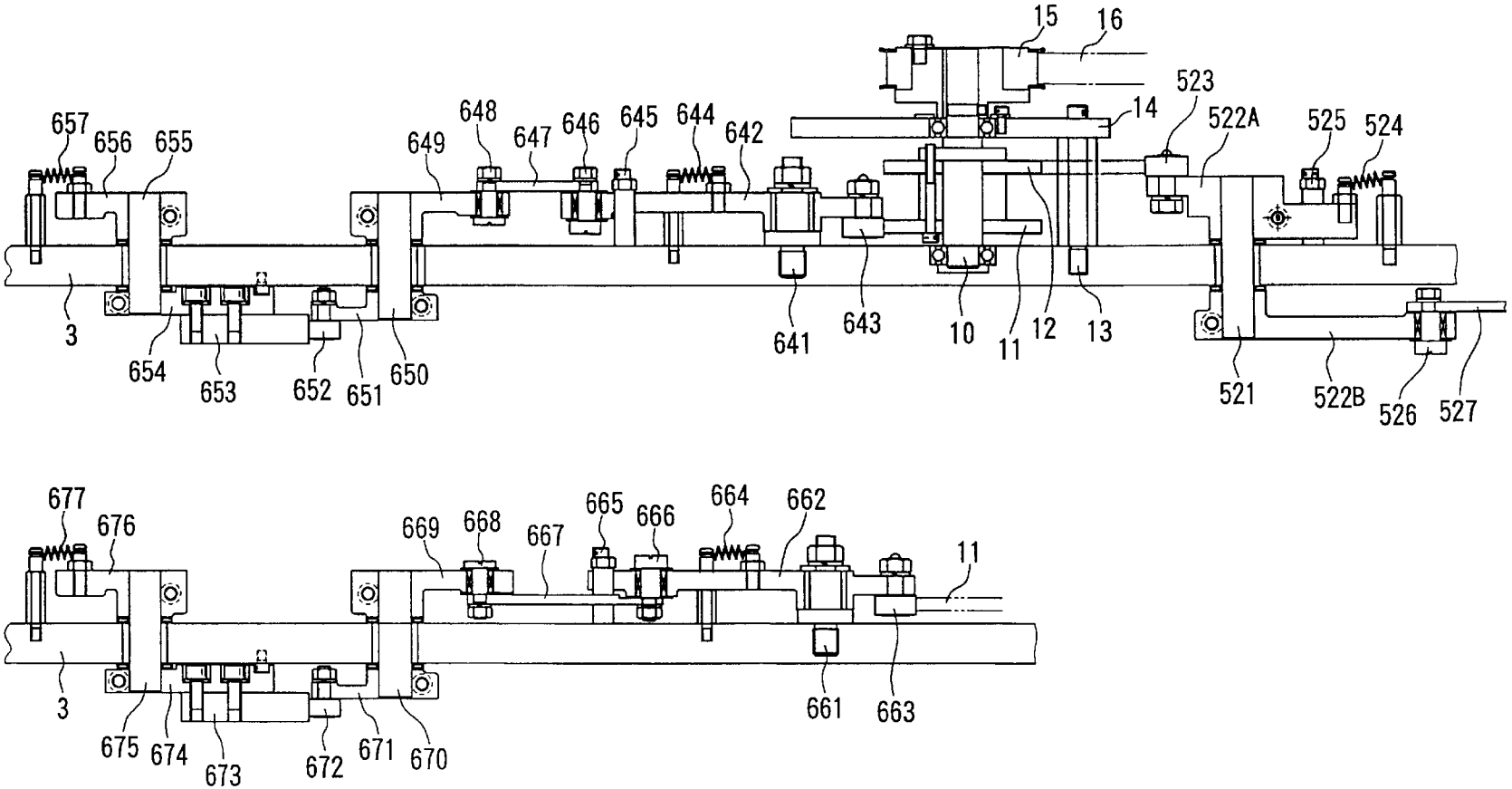
FIG. 4 is a developmental view showing configuration of the sheet feed cylinder gripper drive mechanism, the sheet feed side impression cylinder gripper drive mechanism, and the sheet discharge side impression cylinder gripper drive mechanism of FIG. 3.
Figure 5:
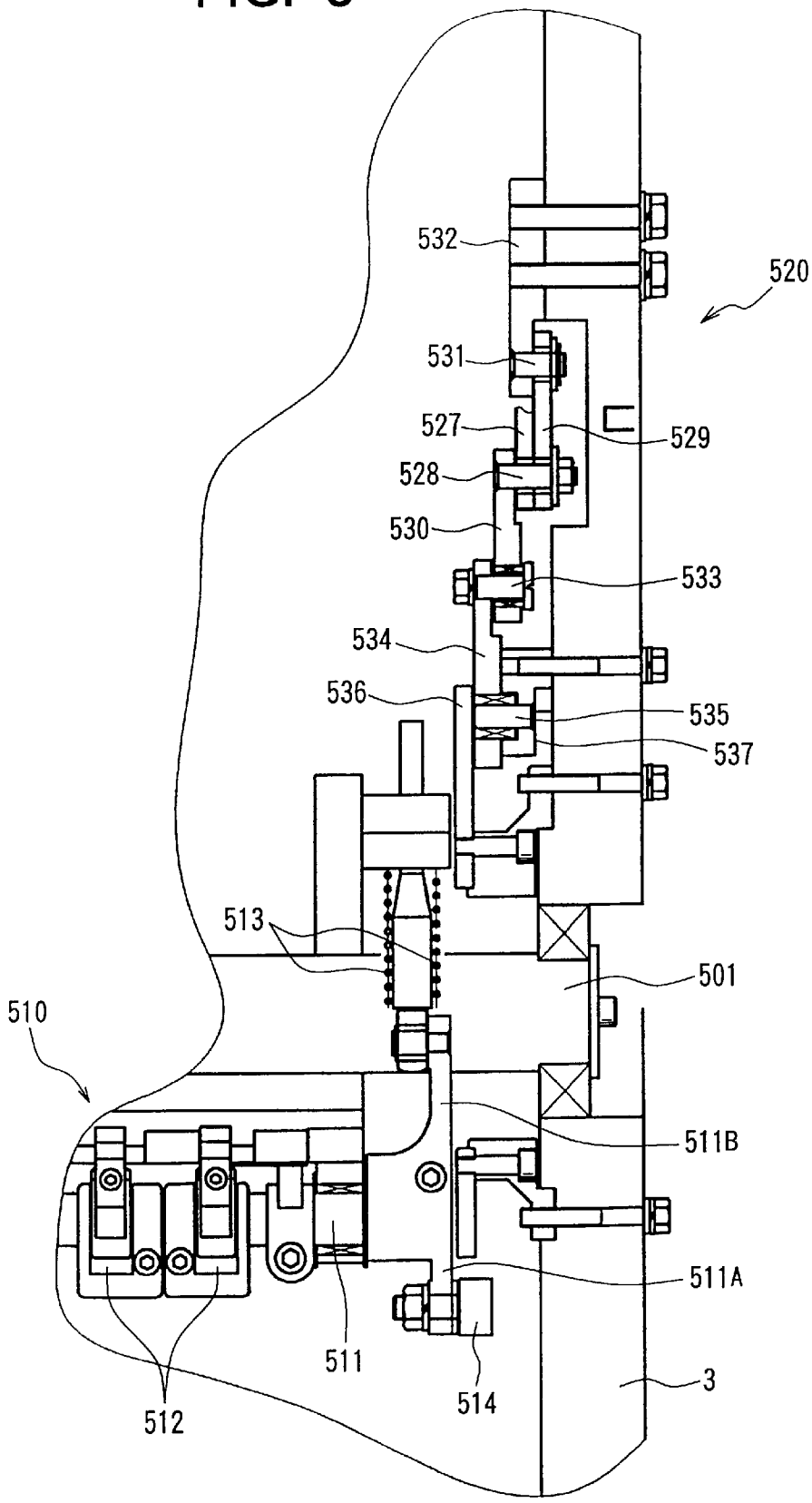
FIG. 5 is a developmental view showing the sheet feed cylinder gripper drive mechanism and the sheet feed cylinder gripper according to the embodiment.
Figure 6:
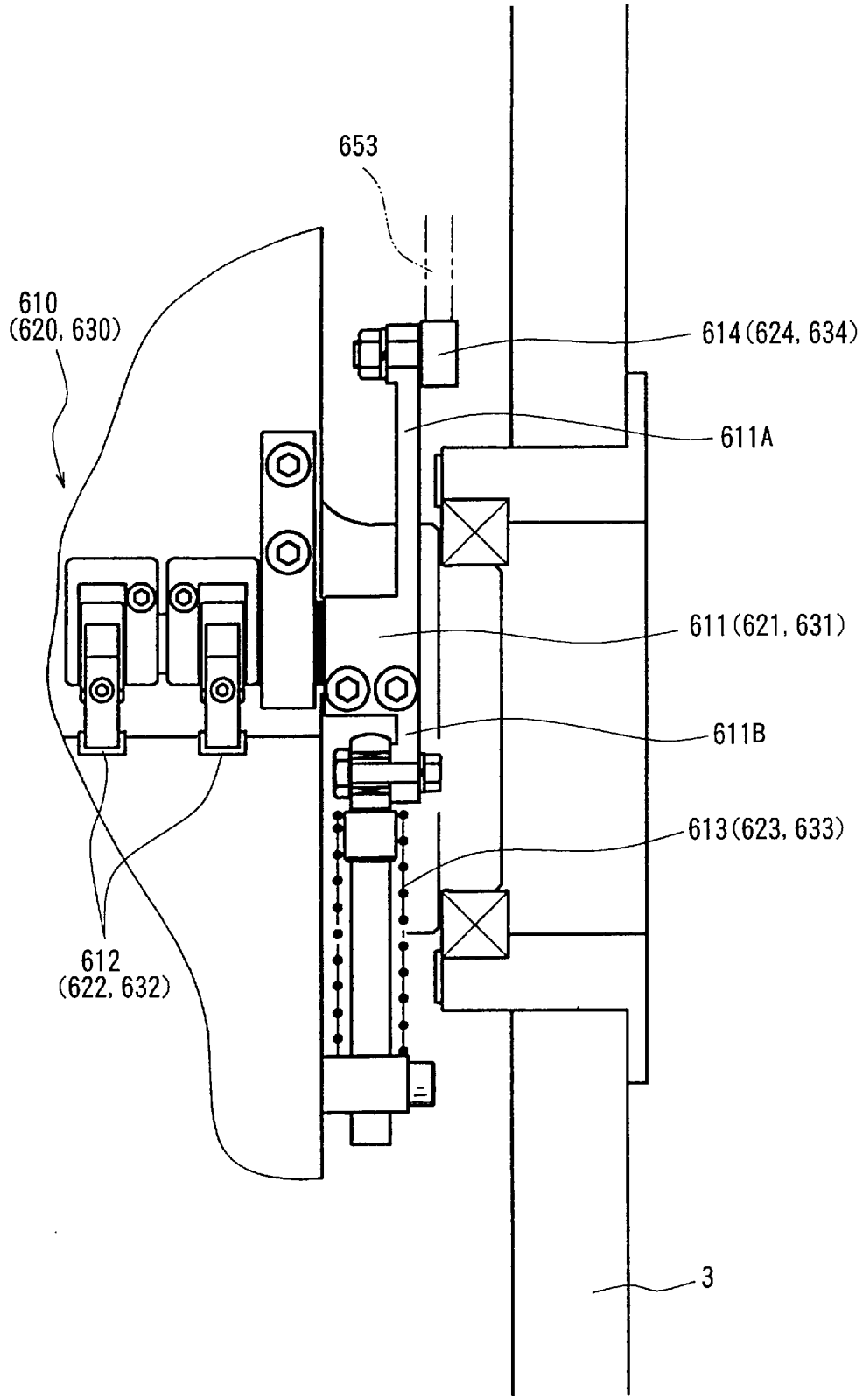
FIG. 6 is a developmental view showing the impression cylinder gripper according to the embodiment.

The above described cylinders and mechanisms are driven by a motor (not shown) fixed to a frame 3 shown in FIGS. 4 to 6. The output shaft of the motor is connected to the impression cylinder 600 through pulleys and gears. The sheet feed cylinder 500 is driven by rotational force of the impression cylinder 600, which is driven by rotation of the impression cylinder 600 from the motor. The abutment mechanism 300 and the sheet lateral position control mechanism 200 are driven by rotational force of the sheet feed cylinder 500. The feeder board 100 is driven by a drive force transmitted from a drive mechanism (not shown) for driving the abutment mechanism 300 and the sheet lateral position control mechanism 200. The sheet discharge sprockets 701, 702 for driving the chain 710 of the sheet discharge mechanism 700 are driven by rotational force of the impression cylinder 600. Further, the blanket cylinders 821, 822 are driven by rotation of the impression cylinder 600, and the plate cylinders 811, 812 are driven by the rotational force of the blanket cylinders 821, 822.

(2) Ink Section 800

The ink section 800 according to the present embodiment provides a printer that uses four different colored inks. Normally, the four colors of ink used are magenta, cyan, yellow, and black. The ink roller group 801, 802, 803, 804 supplies different colors of ink to the plate cylinders 811, 812.

The peripheral surface of each of the plate cylinders 811, 812 is divided into two equal semicircular plate regions 811*a*, 811*b* and 812*a*, 812*b* respectively. Each of the four regions 811*a*, 811*b*, 812*a*, 812*b* is formed with a plate that corresponds to one of the colors supplied by the ink roller group 801, 802, 803, and 804, and is supplied with ink from only a corresponding one of the ink roller group 801, 802, 803, and 804. The plate cylinders 811, 812 are adapted for forming ink images on the peripheral surface of the blanket cylinders 821, 822.

The blanket cylinders 821, 822 each have an outer peripheral surface the same length as that of the plate cylinders 811, 812. The blanket cylinders 821, 822 are divided in their circumferential direction into two different color sections 821*a*, 821*b* and 822*a*, 822*b* respectively, in the same number of divisions as the outer peripheral surface of the plate cylinder 811, 812. The plate cylinders 811, 812 and the blanket cylinders 821, 822 rotate at the same speed so as not to shift in position where they contact. The four color sections 821*a*, 821*b*, 822*a*, 822*b* on the outer surface of the blanket cylinders 821, 822 correspond to the four plate sections 811*a*, 811*b*, 812*a*, 812*b* on the peripheral surface of the plate cylinders 811, 812. The blanket cylinders 821, 822 and the plate cylinders 811, 812 rotate in association so that the start points (and end points) of the color sections 821*a*, 821*b*, 822*a*, 822*b* match the start points (and end points) of the corresponding plate regions 811*a*, 811*b*, 812*a*, 812*b*.

The outer peripheral surface of the impression cylinder 600 is divided uniformly in the circumferential direction into three segments 600*a*, 600*b*, and 600*c*, each having the same length as the color sections 821*a*, 821*b*, 822*a*, 822*b* of the blanket cylinders 821, 822. The impression cylinder 600 rotates ⅔ times for each entire turn of the plate cylinders 811, 812 and each entire turn of the blanket cylinders 821, 822, so as not to shift in position where they contact. The segments 600*a*, 600*b*, 600*c* of the impression cylinder 600 each correspond to one of the color sections 821*a*, 821*b*, 822*a*, 822*b* of the blanket cylinders 821, 822. The impression cylinder 600 and the blanket cylinders 821, 822 rotate in association so that the start points (and end points) of the segments 600*a*, 600*b*, and 600*c* match the start points (and end points) of the color sections 821*a*, 821*b*, 822*a*, 822*b*.

(3) Impression Cylinder Grippers 610, 620, 630

Impression cylinder grippers 610, 620, 630 each provided with impression pawls 612, 622, 632 for holding a sheet on the outer peripheral surface of the impression cylinder 600 are provided at the leading end edges of the segments 600*a*, 600*b*, and 600*c*. These impression cylinder grippers 610, 620, 630 are fixed to the impression cylinder 600, so that the grippers can be circularly moved upon rotation of the impression cylinder 600.

The impression cylinder grippers 610, 620, 630 are each for holding a single sheet against the segments 600*a*, 600*b*, 600*c*, and are capable of switching between a closed condition (closed position) for holding a sheet and an open condition (open position) for receiving or releasing a sheet. In the open position, impression cylinder pawls 612, 622, 632 (FIG. 3) provided to the impression cylinder grippers 610, 620, 630 move to a position away from the outer peripheral surface of the impression cylinder 600 in a radially outward direction of the impression cylinder 600. In the closed condition, the impression cylinder pawls 612, 622, 632 provided to the impression cylinder grippers 610, 620, 630 move to positions in conformance with the outer peripheral surface of the impression cylinder 600. Each impression cylinder pawl of each impression cylinder gripper 610, 620, 630 is configured to enter each recessed portion (to be described later), which is formed in the outer peripheral surface of the sheet feed cylinder 500, at a sheet transfer position (contact position) 600S between the impression cylinder 600 and the sheet feed cylinder 500.

Each of the impression cylinder grippers 610, 620, 630 includes a plurality of gripers arrayed in a row in a direction parallel to the center axis of the impression cylinder 600.

FIG. 6 shows details of the configuration of the impression cylinder grippers 610, 620, and 630. The impression cylinder grippers 610, 620, 630 all have the same configuration, so the following description will be made for the impression cylinder gripper 610 as a representative example. Members of the impression cylinder gripper 620, 630 that correspond to those of the impression cylinder gripper 610 are referred to using the numbering increased by 10 and 20, respectively.

A pawl shaft 611 is provided on the impression cylinder gripper 610. The pawl shaft 611 has a length substantially the same as the axial length of the impression cylinder 6. The pawl shaft 611 extends perpendicular to the frame 3. First and second arm members 611A and 611B are provided integrally with the pawl shaft 611 and extend in parallel with the frame 3. A plurality of impression cylinder pawls 612 are provided in a row aligned in the axial direction of the impression cylinder 600 and are provided integrally with the pawl shaft 611. A plurality of recessed portions are formed on the outer peripheral surface of the impression cylinder 600 for allowing the sheet feed cylinder gripper 510 to enter into the impression cylinder 600. The recessed portions are arrayed in alternate relationship with the impression cylinder pawls 612.

A cam follower 614 for abutting against grip switching cams 653, 673 (described later) is provided on a free end of the first arm member 611A. A spring 613 is connected between the impression cylinder 600 and a free end of the second arm member 611B for normally urging the impression cylinder pawls 612 into its closed position where the impression cylinder pawls abut against associated impression cylinder pawl stand (not shown) to hold a sheet. When the cam follower 614 is located on the cam surface of the grip switching cam 653 or 673, the impression cylinder pawls 612 move against the urging force of the spring 613 into an open position, separated from the impression cylinder pawl stand to either receive or release a sheet.

As will be described later, drive force for switching the impression cylinder grippers 610, 620, 630 to their open condition at a position directly before the contact position 600S, that is, drive force for driving the impression cylinder grippers 610, 620, 630 for receiving each sheet therein is transmitted once each time the impression cylinder 600 rotates two thirds of a full rotation. The value of "two thirds(⅔)" of a full rotation of the impression cylinder 600 is determined by dividing the number of color section in the blanket cylinder by the number of segments in the impression cylinder.

With this configuration, when one of the impression cylinder grippers 610, 620, 630 approaches the sheet feed cylinder 500, a switching operation is performed to bring that impression cylinder gripper into its open condition to receive a sheet from the sheet feed cylinder 500. After the impression cylinder 600 has rotated one third of a full rotation, the next impression cylinder gripper 610, 620, 630 near the sheet feed cylinder 500 maintains its closed condition. In other words, open condition switching operation that is associated with sheet transfer and a closed condition maintenance operation that is unassociated with sheet transfer are performed in alternation. During the open condition switching operation, the corresponding impression cylinder gripper 610, 620, or 630 is brought into its open position directly before it reaches the contact position 600S and is switched into its closed condition at a position directly after it passes by the contact position 600S. During the closed condition maintenance operation, the impression cylinder gripper 610, 620 or 630 is maintained in closed condition when the circular position of the gripper is directly before and after the contact position 600S.

As will be described later, drive force for switching the impression cylinder gripper 610, 620, 630 into the open condition at a position immediately after it reaches a most proximity position (sheet discharge position) 600D between the impression cylinder 600 and the sheet discharge mechanism 700, that is, the drive force for the operation to release a sheet from the impression cylinder grippers 610, 620, 630, is transmitted once each time the impression cylinder 600 rotates two thirds of a full rotation. It should be noted that "two thirds " of a full rotation of the impression cylinder 600 is determined by the number of color sections in each of the blanket cylinders 821, 822 divided by the number of segments in the impression cylinder 600. The open condition switching operation is performed on one of the impression cylinder grippers 610, 620, 630 when it approaches the sheet discharge mechanism 700. The closed condition maintenance operation is then performed on one of the impression cylinder grippers 610, 620, 630 after the impression cylinder 600 rotates one third of a full rotation. In this manner, the open condition switching operation and the closed condition maintenance operation are performed alternately as the impression cylinder grippers 610, 620, 630 approach and pass by the sheet discharge mechanism 700. That is, during the open condition switching operation, each impression cylinder gripper 610, 620, 630 is maintained at its closed condition immediately before it reaches the most proximity position 600D, and is switched into its open condition immediately after it reaches the most proximity position 600D. During the closed condition maintenance operation, each impression cylinder gripper 610, 620, 630 is maintained in the closed condition before and after it reaches the most proximity position 600D.

(4) Sheet Feed Mechanism

The feeder board 100 in the sheet feed mechanism is formed in a conveyer belt shape. One sheet at a time from the sheet feed pile 1 is placed on the upper surface of the feeder board 100 and transported to the infeed portion 900. The feeder board 100 is driven at a speed for transporting a single sheet each time the impression cylinder 600 rotates two thirds of a full rotation.

The infeed portion 900 includes a swing mechanism 400, a front lay mechanism 300, and a sheet lateral position control mechanism 200. The swing mechanism 400 is adapted for transferring the sheet from the feeder board 100 to the sheet feed cylinder 500. The front lay mechanism and the sheet lateral position control mechanism 200 are adapted for regulating a position and orientation of the sheet on a sheet feed passage before transferring the sheet to the sheet feed cylinder 500 from the feeder board 100.

The front lay mechanism (abutment mechanism) for aligning the orientation of the sheet is positioned between the feeder board 100 and the swing mechanism 400. The front lay mechanism (abutment mechanism) includes an abutment member 301 and an abutment member driving mechanism 310. The abutment member 301 is movable between an intrusion position (projecting position) where the abutment member 301 intrudes into a sheet transport pathway between the feeder board 100 and the swing mechanism 400, and a retracted position away from the sheet transport pathway. The abutment member driving mechanism 310 is connected to the abutment member 301 to move the abutment member 301 between its intrusion position and its retracted position. The abutment member driving mechanism 310 normally holds the abutment member 301 in its intrusion position. However, the abutment member driving mechanism temporarily moves the abutment member 301 in its retracted position each time the impression cylinder 600 rotates two thirds of a full rotation.

The sheet lateral position control mechanism 200 is provided between the feeder board 100 and the front lay mechanism 300. The sheet lateral position control mechanism 200 is adapted for moving sheets in a widthwise direction to a predetermined position on the sheet transport pathway to align a widthwise edge of each sheet with a predetermined line. The sheet lateral position control mechanism 200 includes a sheet holding portion (not shown) and a sheet holding portion drive mechanism (not shown). The sheet holding portion is positioned on the sheet transport pathway and between the feeder board 100 and the abutment portion of the front lay mechanism 300 for holding the sheet and moving the sheet in its widthwise direction. Further, the sheet holding portion driving mechanism is adapted for moving the sheet holding portion in order to selectively allow the sheet to pass therethrough, or in order to have the holding portion to hold the sheet and move the holding portion in the widthwise direction of the sheet. The sheet holding portion drive mechanism permits the sheet holding portion to hold and move the sheet in its widthwise direction, each time the impression cylinder 600 rotates two thirds of a full rotation (each time the sheet feed cylinder rotates twice).

The swing mechanism 400 includes a swing gripper 410 including swing pawls and swing pawl stands (not shown) for nipping a leading edge of a sheet transported from the feeder board 100 therebetween for holding the sheet. The swing pawls are pivotally movable with respect to the swing pawl stands between closed position for holding sheets in association with the swing pawl stands and open position for receiving and releasing sheets. The swing pawls and the swing pawl stands of the swing gripper 410 are integrally reciprocally movable between a position near the feeder board 100 and a standby position (not shown) moving past near the outer peripheral surface of the sheet feed cylinder 500. Further, the swing gripper is so positioned that the swing pawls of the swing gripper can enter into a recess (not shown) formed on the outer peripheral surface of the sheet feed cylinder 500 when the swing gripper moves to the vicinity of a contact portion with the sheet feed cylinder 500.

Switching to the open position and subsequent switching to the closed position of the swing pawls at a position near the feeder board 100, that is, sheet receiving operation from the feeder board 100 to the swing mechanism 400 is performed once, each time the impression cylinder 600 rotates two third of full rotation. Further, the swing gripper 410 is reciprocally moved once between the position near the feeder board 100 and the standby position, each time the impression cylinder rotates one third of full rotation (each time the sheet feed cylinder rotates once).

In this way, during the single operation cycle of the infeed portion 900, the reciprocal movement of the swing gripper that accompanies sheet transfer, and the reciprocal movement of the swing gripper that does not accompany sheet transfer, are performed alternately. To be more specific, it will be assumed that the impression cylinder 600 is in its 0th rotation when the first sheet reaches near the abutment member. In this case, the sheet holding portion of the sheet lateral position control mechanism 200 is positioned to allow sheets to pass therethrough, so a sheet passes near the sheet holding portion of the sheet lateral position control mechanism 200. Further, the abutment member of the front lay mechanism 300 is positioned in its protrusion position so that the leading edge of a sheet transported by the feeder board 100 abuts against the abutment member so that further transport of the sheet by the swing mechanism 400 is prevented. The operation of the abutment member that prevents sheet supply and the operation of the feeder board 100 that transports sheets work together to adjust the orientation of the sheet so that its leading edge in the transport direction is aligned parallel with the center axis of the sheet feed cylinder 500. At this time, the sheet holding portion driving mechanism of the sheet lateral position control mechanism 200 is driven to permit the sheet holding portion to hold the sheet and to move the holding portion in the widthwise direction of the sheet. Thus, the sheet is moved to the predetermined widthwise position. As a result, sheet alignment is performed before the sheet is held between the swing pawls of the swing gripper 410 and the swing pawl stands. At this time, the swing pawls of the swing gripper 410 moves into its open position so the swing gripper 410 is ready to receive a sheet. Then, the swing gripper pawl is moved to its closed position to nip the leading edge of the sheet between the swing pawls and the swing pawl stands. Afterwards, the sheet holding portion drive mechanism of the sheet lateral position control mechanism 200 moves the sheet holding portion so that the sheet can pass thereby, and the abutment member of the front lay mechanism 300 is moved to the retraction position by the abutment member driving mechanism. The swing gripper moves the swing pawls and the swing pawl stands from the position near the feeder board 100 to near the outer peripheral surface of the sheet feed cylinder 500 while the swing pawls are maintained in their closed position, that is, while the sheet is held in the swing gripper 410. Then the swing pawls move to their open position for releasing a sheet, whereupon the sheet is passed to the sheet feed cylinder 500. Next, the swing gripper 410 moves to its standby position (not shown) and then again moves past the peripheral surface of the sheet feed cylinder 500 and returns to its position near the feeder board 100.

Because the feeder board 100 transports a single sheet at a transport speed each time the impression cylinder 600 rotates two thirds of a full rotation, when the impression cylinder 600 is in its $1/3^{th}$ rotation, no sheet is supplied to the infeed portion 900. The swing mechanism 400 operates in the same manner as $0^{th}$ rotation described above. However, because no sheet is supplied to the swing mechanism 400, the swing gripper 410 holds no sheet when the swing gripper 410 with the swing pawls and the swing pawl stands moves from near the feeder board 100, past the outer peripheral surface of the sheet feed cylinder 500, into its standby position (not shown). No sheet is passed to the sheet feed cylinder 500. Then, the swing gripper 410 with the swing pawls and the swing pawl stands moves from the standby position (not shown), past the outer peripheral surface of the sheet feed cylinder 500, and back to its position near the feeder board 100.

Because the feeder board 100 supplies a single sheet each two thirds of a full rotation of the impression cylinder 600, the same operations as performed in $0^{th}$ rotation are performed when the impression cylinder 600 rotates another one third of a full rotation into its $2/3^{th}$ rotation, that is, when it rotates 240 degrees.

As described above, the outer peripheral length of the sheet feed cylinder 500 is the same length as the peripheral length of the color sections 821*a*, 821*b*, 822*a*, 822*b* of the blanket cylinders 821, 822. That is, the outer peripheral length of the sheet feed cylinder 500 is the same length as the peripheral length of the segments 600*a*, 600*b*, 600*c* of the impression cylinder 600. Driving force is transmitted to the sheet feed cylinder 500 so that the sheet feed cylinder 500 rotates a single rotation each time the impression cylinder 600 rotates one third of full rotation.

(5) Sheet Feed Cylinder Gripper 510

A sheet feed cylinder gripper 510 is provided to the sheet feed cylinder 500 at a position along the outer peripheral surface thereof. The sheet feed cylinder gripper 510 has sheet feed cylinder pawls 512 for supporting the sheet on the outer peripheral surface of the sheet feed cylinder 500. The sheet feed cylinder gripper 510 is fixed to the sheet feed cylinder 500 so as to move with rotation of the sheet feed cylinder 500.

The sheet feed cylinder gripper 510 is so positioned such that the sheet feed cylinder gripper 510 reaches the contact portion 600S when one of the impression cylinder grippers 610, 620, 630 each provided at each leading edge of each segment 600*a*, 600*b*, 600*c* simultaneously reaches the contact portion 600S in accordance with the rotation of the sheet feed cylinder 500 and the impression cylinder 600. Each sheet feed cylinder gripper 510 enters into each recess formed in the peripheral surface of the impression cylinder 600 when located at the contact position 600S. The recesses are formed on the outer peripheral surface of the impression cylinder 600 in alternating fashion with impression cylinder gripper pawls 612. Further, each sheet feed cylinder gripper 510 intersects with the swing pawls when the swing gripper 410 approaches the outer peripheral surface of the sheet feed cylinder 500.

The sheet feed cylinder gripper 510 is adapted for supporting a single sheet on the sheet feed cylinder 500. The sheet feed cylinder gripper 510 can be switched between a closed condition (closed position) for holding a sheet and an open condition (open position) for releasing or receiving a sheet. During the open condition, the sheet feed cylinder pawls 512 shown in FIG. 5 provided on the sheet feed cylinder gripper 510 moves in the radially outward direction of the sheet feed cylinder 500 away from the outer peripheral surface of the sheet feed cylinder 500. During the closed condition, the sheet feed cylinder pawls 512 move to a position in conformance with the outer peripheral surface of the sheet feed cylinder 500. The sheet feed cylinder pawls 512 are configured to intrude into the above-described recess formed in the outer peripheral surface of the impression cylinder 600 at the contact position 600S between the impression cylinder 600 and the sheet feed cylinder 500.

FIG. 5 shows detailed configuration of the sheet feed cylinder gripper 510. A pawl shaft 511 is provided on the sheet feed cylinder gripper 510. The pawl shaft 511 extends perpendicular to the frame 3 to a length equivalent to the axial length of the sheet feed cylinder 500. First and second arm portion 511A, 511B are provided integrally with the pawl shaft 511 and extend parallel with the frame 3. A plurality of sheet feed cylinder pawls 512 are provided integrally with the pawl shaft 511 and are arrayed in a row parallel with the axial direction of the sheet feed cylinder 500. Recesses are formed on the outer peripheral surface of the sheet feed cylinder 500 in a row aligned with the row of sheet feed pawls 512 and in alternate fashion therewith so as to allow the impression cylinder pawls 612, 622, 632, and the swing pawls of the swing gripper 410 to enter into the corresponding recess.

A cam follower 514 is provided at a free end of the first arm portion 511A. The cam follower 514 is for abutting against a movable cam 534 and a fixed cam 536 described later. A spring 513 is connected between the sheet feed cylinder 500 and a free end of the second arm portion 511B for urging the sheet feed cylinder pawls 512 into a closed position where the sheet feed cylinder pawls 512 contact sheet feed cylinder pawl stands (not shown) to hold a sheet. When the cam follower 514 contacts the cam surface of the fixed cam 536 or the movable cam 534, the sheet feed cylinder pawls 512 move against the urging force of the spring 513 into an open position where the sheet feed cylinder pawls 512 are separated from the sheet feed cylinder pawl stands (not shown) to either receive or re-lease a sheet.

The operation for switching the sheet feed cylinder gripper 510 into its open condition when the sheet feed cylinder gripper 510 approaches the swing mechanism 400 is performed once each time the impression cylinder 600 rotates one third of a full rotation (each time the sheet feed cylinder 500 rotates once). At this time, a sheet is received by the sheet feed cylinder gripper 510, assuming that the sheet has been supplied from the swing mechanism 400. On the other hand, if no sheet has been supplied from the swing mechanism 400, then the sheet feed cylinder gripper 510 will not receive a sheet.

The operation for switching the sheet feed cylinder gripper 510 into its open condition immediately after the sheet feed cylinder gripper 510 reaches the contact position 600S is performed once each time the impression cylinder 600 rotates one third of a full rotation (at every single rotation of the sheet feed cylinder 500). The operation for switching the sheet feed cylinder gripper 510 into its open condition immediately before the sheet feed cylinder gripper 510 reaches the contact position 600S is performed once each time the impression cylinder 600 rotates two thirds of a full rotation, or said differently, each time the sheet feed cylinder 500 rotates completely two times. That is, two operations are performed alternately each time the impression cylinder 600 rotates two thirds of a full rotation, that is, each time the sheet feed cylinder 500 rotates twice. One operation is performed for a sheet feed cylinder gripper 510 that holds no sheet, and the other is performed for a sheet feed cylinder gripper 510 that holds a sheet. In the one operation, the sheet feed cylinder gripper 510 without a sheet is maintained in its open condition from immediately before it reaches the con-tact position 600S to immediately after it reaches the con-tact position 600S. In another operation, the closed position of the sheet feed cylinder gripper 510 is maintained immediately before it reaches the contact position 600S and is brought into its open condition immediately after it reaches the contact position 600S. When performing the one operation in which the sheet feed cylinder gripper 510 holds no sheet, then as will be described later, the impression cylinder grippers 610, 620, 630 that meet the sheet feed cylinder gripper 510 will be supporting the sheet, so the sheet feed cylinder gripper 510 retracts away from the transfer pathway of the sheet held by the impression cylinder 600 to avoid tearing the sheet. On the other hand, in the other operation in which the sheet feed cylinder gripper 510 supports the sheet, as will be described later, the impression cylinder grippers 610, 620, 630 that meet the sheet feed cylinder gripper 510 will be supporting no sheet, so the sheet held by the sheet feed cylinder gripper 510 will be released, and will be transferred to the impression cylinder grippers 610, 620, 630 that meet the sheet feed cylinder gripper 510.

In this way, the sheet feed cylinder gripper 510 alternately performs a first kind of open condition switching operation for transferring a sheet, and a second kind of open condition switching operation which does not result in transferring a sheet, each time the sheet feed cylinder gripper 510 approaches the impression cylinder 600. During the first kind of open condition switching operation associated with sheet transfer, the sheet feed cylinder gripper 510 is in its closed condition at a position directly before reaching the contact position 600S and is switched to its open condition directly after reaching the contact position 600S. During the second kind of open condition switching operation not associated with sheet transfer, the sheet feed cylinder gripper 510 is maintained in its open condition from directly before to directly after it reaches the contact position 600S.

(6) Sheet Discharge Mechanism 700

As described above, the sheet discharge mechanism 700 includes the sheet discharge sprockets 701, 702, endless chain 710, and sheet discharge grippers 720, 730. The endless chain 710 is mounted on the sheet discharge sprockets 701, 702 and is transported by the rotation of the sheet discharge sprockets 701, 702. The drive force rotating the sheet discharge blankets 701, 702 is set so that the transport speed of the endless chain 710 can be equal to a peripheral speed of the impression cylinder 600. The overall length of the chain 710 is equivalent to an integral multiple of the outer peripheral surface length of the blanket cylinders 821, 822. According to the present embodiment, the overall length of the chain 710 is approximately twice the length of the outer periphery length of the blanket cylinders 821, 822. The sheet discharge grippers 720, 730 for holding a printed sheet on the sheet discharge mechanism 700, is fixed on the chain 710 and moves in association with the transport of the chain 710. The sheet discharge grippers 720, 730 are disposed on the chain 710 separated by a distance approximately equivalent to the outer periphery length of the blanket cylinders 821, 822, that is, the distance approximately twice the outer peripheral surface of each of segments of the impression cylinder 600. Thus, the sheet discharge grippers 720, 730 are configured to reach the most proximity position 600D between the sheet discharge mechanism 700 and the impression cylinder 600, each time the impression cylinder 600 rotates two thirds of a full rotation. Also in association with rotation of the impression cylinder 600 and the transport of the endless chain 710, the sheet discharge gripper 720 or 730 reaches the sheet discharge position 600D simultaneously when one of the impression cylinder grippers 610, 620, 630 reaches the sheet discharge position 600D. At this time, the sheet discharge grippers 720 or 730 is aligned in a line with the corresponding one of the impression cylinder grippers 610, 620, 630.

The sheet discharge grippers 720, 730 can switch between a closed condition (closed position) for holding a sheet and an open condition (open position) for receiving or releasing a sheet. Said in more detail, the sheet discharge grippers 720, 730 are switched into their open condition for receiving a sheet when they reach the sheet discharge position 600D between the sheet discharge mechanism 700 and the impression cylinder 600, and again are switched into the open condition for releasing a sheet when approaching a discharge pile 2. Normally, the sheet discharge grippers 720, 730 are in their closed condition except when they are in the open condition at the timing described above.

(7) Operation

Next, operation of the offset printing machine according to the embodiment will be described. First, operation for forming an ink image on a sheet provided to the outer peripheral surface of the impression cylinder 600 will be described. The ink roller groups 801, 802, 803, 804 supply inks of different colors to the plate regions 811*a*, 811*b*, 812*a*, 812*b* of the plate cylinders 811, 812. For example, the ink roller group 801 supplies ink to only the plate region 811*a*. The ink roller group 802 supplies ink only to the plate region 811*b*. The ink roller group 803 supplies ink only to the plate region 812*a*. The ink roller group 804 supplies ink only to the plate region 812*b*.

Next, the plate regions 811*a*, 811*b*, 812*a*, 812*b* consequently form images on the corresponding color sections 821*a*, 821*b*, 822*a*, 822*b* of the blanket cylinders 821, 822.

Next, the color sections 821*a*, 821*b*, 822*a*, 822*b* with ink images formed thereon contact the sheets supported on each of the segments 600*a*, 600*b*, 600*c* so that the ink image formed on the color sections 821*a*, 821*b*, 822*a*, 822*b* is transferred onto the sheets. At this time, each time the blanket cylinder 821 or 822 contacts a sheet once, an ink image in a single color is transferred onto the sheet. All four different colored ink images are transferred onto a sheet supported on the outer surface of the impression cylinder 600 when the impression cylinder 600 rotates twice. In the situation shown in FIG. 1, the ink image from the color section 821*a* is being transferred onto a sheet supported on the segment 600*a*. Thereafter, in accordance with the subsequent rotation of the impression cylinder 600, the sheet supported on the segment 600*a* will be brought into confrontation with the blanket cylinder 822, whereupon the ink image from the color region 822*b* will be transferred onto the sheet. After the impression cylinder 600 rotates one complete time back to the condition shown in FIG. 1, the blanket cylinders 821, 822 will have rotated three/two times. Therefore, the sheet supported on the segment 600*a* will be in confrontation with the color section 821*b*, so that the color image on the color section 821*b* will be transferred onto the sheet. Further rotation will bring the sheet supported on the segment 600*a* into confrontation with the color region 822*a* so that its ink image is transferred onto the sheet. As a result, the identical sheet will have received a transfer of four different colored ink images.

Next, transport operations for the sheet will be described. The sheet transferred by the feeder board 100 is subjected to position adjustment at a terminal end of the feeder board 100 near the infeed portion 900 by the front lay mechanism 300 and the sheet lateral position control mechanism 200. Then, after the swing gripper 410 grips the sheet, the front lay mechanism 300 performs operation for allowing the sheet to pass therethrough. Thus, the sheet is transferred toward the sheet feed cylinder 500 by the swing mechanism 400, and the sheet is transferred from the swing gripper 410 of the swing mechanism 400 to the sheet feed cylinder gripper 510 of the sheet feed cylinder 500. The sheet is supported on the outer surface of the sheet feed cylinder 500 and transported toward the impression cylinder 600. When the leading edge of the sheet reaches the contact position 600S, the sheet is transferred from the sheet feed cylinder gripper 510 to one of the impression cylinder grippers 610, 620, 630 that is presently at the contact position 600S. The impression cylinder grippers 610, 620, 630 continuously support the sheet on the outer surface of the impression cylinder 600 during almost twice rotation of the impression cylinder 600. That is, even though the sheet reaches the sheet discharge mechanism 700 after the impression cylinder 600 rotates almost once, the sheet will not be transferred to the sheet discharge mechanism 700, but will be maintained supported on the impression cylinder 600 until all four different colored ink images are transferred onto the sheet. At this point, the impression cylinder grippers 610, 620, 630 holding the sheet will transfer the sheet to the sheet discharge gripper 720 or 730 of the sheet discharge mechanism 700. Afterwards the sheet is transported by the chain 710, and when the sheet reaches the discharge pile 2, the sheet discharge gripper 720 or 730 holding the sheet is switched to its open condition for releasing the sheet, so that the sheet will land on the discharge pile 2.

As described above, each sheet is supported on the outer peripheral surface of the impression cylinder 600 while the impression cylinder 600 rotates two full times. It is important to note that a single sheet is supplied to every other one of the segments 600*a*, 600*b*, 600*c*. That is, when a sheet is supplied to the segment 600*a* as shown in FIG. 1, then no sheet will be supplied to the segment 600*b*, but a sheet will be supplied to the segment 600*c*. The next time, the segment 600*a* will not be supplied with a sheet. Also, sheets are discharged from every other segments 600*a*, 600*b*, 600*c*. That is, when a sheet is discharged from the segment 600*a*, then the sheet on the segment 600*b* will not be discharged. The sheet on the segment 600*c* will then be discharged, but then the sheet on the segment 600*a* will not be discharged.

Here, operations for feeding sheets to the impression cylinder 600 will be described, assuming that a first sheet is fed to the segment 600*a*. First, when the front lay mechanism 300 and the sheet lateral position control mechanism 200 regulate the position of a sheet, the swing gripper 410 will be positioned near the feeder board 100, and holds the sheet. After the front lay mechanism 300 performs to allow the sheet to pass therethrough (after retracted movement of the abutment member), the swing gripper 410 is moved from the position near the feeder board 100 to near the outer peripheral surface of the sheet feed cylinder 500. At this timing, the sheet feed cylinder gripper 510 also moves toward the swing grippers 410 because of the rotation of the sheet feed cylinder 500. As the sheet feed cylinder gripper 510 approaches the swing gripper 410, the sheet feed cylinder gripper 510 is switched to its open condition so that the sheet feed cylinder gripper 510 can receive the sheet. Then, when the sheet feed cylinder gripper 510 is brought into its closed condition, the sheet will be held by both the sheet feed cylinder gripper 510 and the swing gripper 410. Immediately after this condition, the swing pawls move to their open condition, so that the sheet is released from the swing gripper 410 and is transferred to the sheet feed cylinder 500. In this condition, the sheet is held on the outer surface of the sheet feed cylinder 500 and is transported by the rotation thereof. Incidentally, this condition will be referred to as zero-th rotation of the impression cylinder 600 in the sheet feeding operation. Directly before the sheet feed cylinder gripper 510 and the impression cylinder gripper 610 reach the contact position 600S, the impression cylinder gripper 610 is switched to its open condition for receiving the sheet into the impression cylinder gripper 610. Then, the impression cylinder gripper 610 is switched back to its closed condition so that the sheet is held by both the impression cylinder gripper 610 and the sheet feed cylinder gripper 510. Afterward, the sheet feed cylinder gripper 510 is switched to its open condition so that the sheet is released from the sheet feed cylinder gripper 510 and the sheet is transferred to the impression cylinder gripper 610. At this point, the sheet is supported on the segment 600*a* and transported by rotation of the impression cylinder 600.

When the impression cylinder 600 rotates one third of a full rotation (hereinafter referred to as $1/3^{rd}$ rotation in the sheet feeding operation), the front lay mechanism 300 and the sheet lateral position control mechanism 200 do not perform sheet position adjustment. In this case, the swing gripper 410 is at its position near the feeder board 100. Because the front lay mechanism 300 does not perform to allow the sheet to pass therethrough (does not move to its retracted position), the sheet will not be supplied to the swing mechanism 400. Further, the swing pawls are not moved to their closed position. Thus, the swing gripper 410 does not perform sheet receiving operation. Furthermore, in this case, a leading edge of a subsequent sheet on the feeder board 100 has not yet been reached the front lay mechanism 300.

Next, the swing gripper 410 moves closer to the sheet feed cylinder 500. At this timing, the sheet feed cylinder gripper 510 approaches the swing gripper 410 and the sheet feed cylinder gripper 510 is switched into its open condition in the same manner as at the zero-th rotation of the impression cylinder 600. However, because the swing grip-per 410 holds no sheet, the swing pawls do not move to their open position and no sheet transfer from the swing mechanism 400 to the sheet feed cylinder 500 is performed. Although the sheet feed cylinder gripper 510 is switched to its closed position, the sheet feed cylinder gripper 510 will be moved to the impression cylinder 600 with rotation of the sheet feed cylinder 500 without holding the sheet. From directly before to directly after the sheet feed cylinder gripper 510 and the impression cylinder gripper 620 reach the contact position 600S, the sheet feed cylinder gripper 510 will be in its open condition and the impression cylinder gripper 620 will be maintained in its closed condition. Thus, no sheet will be supplied to the segment 600*b*. This series of operations is thus not associated with sheet transfer.

When the impression cylinder 600 further rotates one third of a full rotation so that the impression cylinder 600 is in its $2/3^{rd}$ rotation, the same operation as described for the $0^{th}$ rotation of the impression cylinder 600 will be performed so that a sheet is transferred onto the segment 600*c* from the sheet feed cylinder 500.

When the impression cylinder 600 further rotates another 1/3 of a full rotation so that it enters its $1^{st}$ rotation, the segment 600*a* of the impression cylinder 600 approaches the sheet feed cylinder 500 and the same operations as described for the $1/3^{rd}$ rotation are again performed. However, the swing gripper 410 will not hold a sheet at this time, so no sheet is transferred from the swing mechanism 400 to the sheet feed cylinder gripper 510. The sheet feed cylinder gripper 510 approaches the contact position 600S without holding a sheet. As will be described later, the sheet supported on the segment 600*a* will not be discharged yet, but will be maintained on the segment 600*a* with only two different colored ink images transferred thereon from the color sections 821*a*, 822*b*. Here, the impression cylinder gripper 610 is maintained in its closed condition from directly before and directly after the sheet feed cylinder gripper 510 and the impression cylinder gripper 610 reach the contact position 600S. As a result, a sheet can be maintained on the segment 600*a*. Further, because the sheet feed cylinder gripper 510 is maintained in its open condition, the sheet feed cylinder gripper 510 will not contact and obstruct the sheet supported on the segment 600*a* so that the sheet will not be damaged.

When the impression cylinder 600 rotates further 1/3 of a rotation, so that the impression cylinder 600 enters its $4/3^{rd}$ rotation, a sheet is supplied onto the segment 600*b*.

Next, a sheet transfer from the impression cylinder 600 to the sheet discharge mechanism 700 will be described. For this explanation, the point in time when the impression cylinder gripper 610 at the leading end of the segment 600*a* first approaches the sheet discharge mechanism 700 after a sheet has been supplied to the impression cylinder gripper 610 at the $0^{th}$ rotation of the impression cylinder 600 during the sheet feed operations will be referred to as $0^{th}$ rotation of the impression cylinder 600 in the sheet discharge operations.

At the start timing of the $0^{th}$ rotation of the impression cylinder 600 in the sheet discharge operation, the impression cylinder gripper 610 provided at the segment 600*a* moves to the sheet discharge position 600D between the impression cylinder 600 and the sheet discharge mechanism 700. At this timing, a lengthwise center point of the chain 710 between the sheet discharge grippers 720 and 730 will face the sheet discharge position 600D, so that the impression cylinder gripper 620 and the sheet discharge grippers 720, 730 will not intersect. Also at the sheet discharge position 600D, the impression cylinder gripper 610 will not be switched to its open condition, but instead will be maintained in its closed condition from directly before to directly after the impression cylinder gripper 610 reaches the sheet discharge position 600D. Accordingly a sheet supported on the segment 600*a* will be maintained supported on the segment 600*a* and passes by the sheet discharge position 600D by the rotation of the impression cylinder 600. At this time, the sheet supported on the segment 600*a* will only have been transferred with two different colored ink images.

During $1/3^{rd}$ rotation of the impression cylinder 600 in the sheet discharge operations, the impression cylinder gripper 620 provided on the segment 600*b* will move toward the sheet discharge position 600D. In synchronization with this timing, the sheet discharge gripper 720 will approach the sheet discharge position 600D. Directly before the impression cylinder gripper 620 and the sheet discharge gripper 720 reach the sheet discharge position 600D, the sheet discharge gripper 720 is switched from its closed condition to its open condition, and is switched back to its closed condition. Directly after this, the impression cylinder gripper 620 is switched to its open condition for transferring the sheet to the sheet discharge mechanism 700. However, at this timing, no sheet has been supplied to the segment 600*b* yet, so no sheet is transferred from the impression cylinder 600 to the sheet discharge mechanism 700.

When the impression cylinder 600 rotates further $1/3^{rd}$ of a full rotation, so that it enters its $2/3^{rd}$ rotation in the sheet discharge operations, the same operations as performed during the $0^{th}$ rotation are repeated so that the sheet supported on the segment 600*c* is transported past the sheet discharge position 600D while maintained on the impression cylinder 600. At this time, the sheet supported on the segment 600*c* will also only be transferred with two different colored ink images.

When the impression cylinder 600 rotates another 1/3 of a full rotation so that it enters the first full rotation in the sheet discharge operations, the sheet supported on the segment 600*a* will have been fully printed with four different colors of ink images and the segment 600*a* will approach the sheet discharge mechanism 700. The impression cylinder gripper 610 will move to the sheet discharge position 600D and the same operations will be performed as in the $1/3^{rd}$ rotation in the sheet discharge operations. That is to say, because a sheet is supported on the segment 600*a*, the sheet will be transferred from the impression cylinder 600 to the sheet discharge mechanism 700. Described in more detail, directly before the impression cylinder gripper 610 and the sheet discharge gripper 730 reach the sheet discharge position 600D, the sheet discharge gripper 730 is switched to its open condition for receiving the sheet. When the sheet discharge gripper 730 is switched back to its closed condition, the sheet will be simultaneously held by both the sheet discharge gripper 730 and the impression cylinder gripper 610. Afterward, when the impression cylinder gripper 610 is switched it its open condition, the sheet will be released from the impression cylinder gripper 610 and transferred completely to the sheet discharge gripper 730. At this time, the sheet will be supported only by the sheet discharge mechanism 700 and transported by the endless chain 710.

With this configuration, the sheet that passes by the sheet discharge mechanism 700 will be maintained supported by the impression cylinder gripper within the range of the $2/3^{rd}$ to first full rotation of the impression cylinder 600 in the sheet feed operations. However, because the sheet discharge grippers 720, 730 are not positioned at the sheet discharge position 600D at this time, the sheet on the impression cylinder 600 will not be damaged by the sheet discharge grippers 720, 730.

(8) Detailed Configuration for Driving Opening and Closing Operations of the Sheet Feed Cylinder Gripper 510, the Impression Cylinder Grippers 610, 620, 630, and the Sheet Discharge Grippers 720, 730

Figure 2:
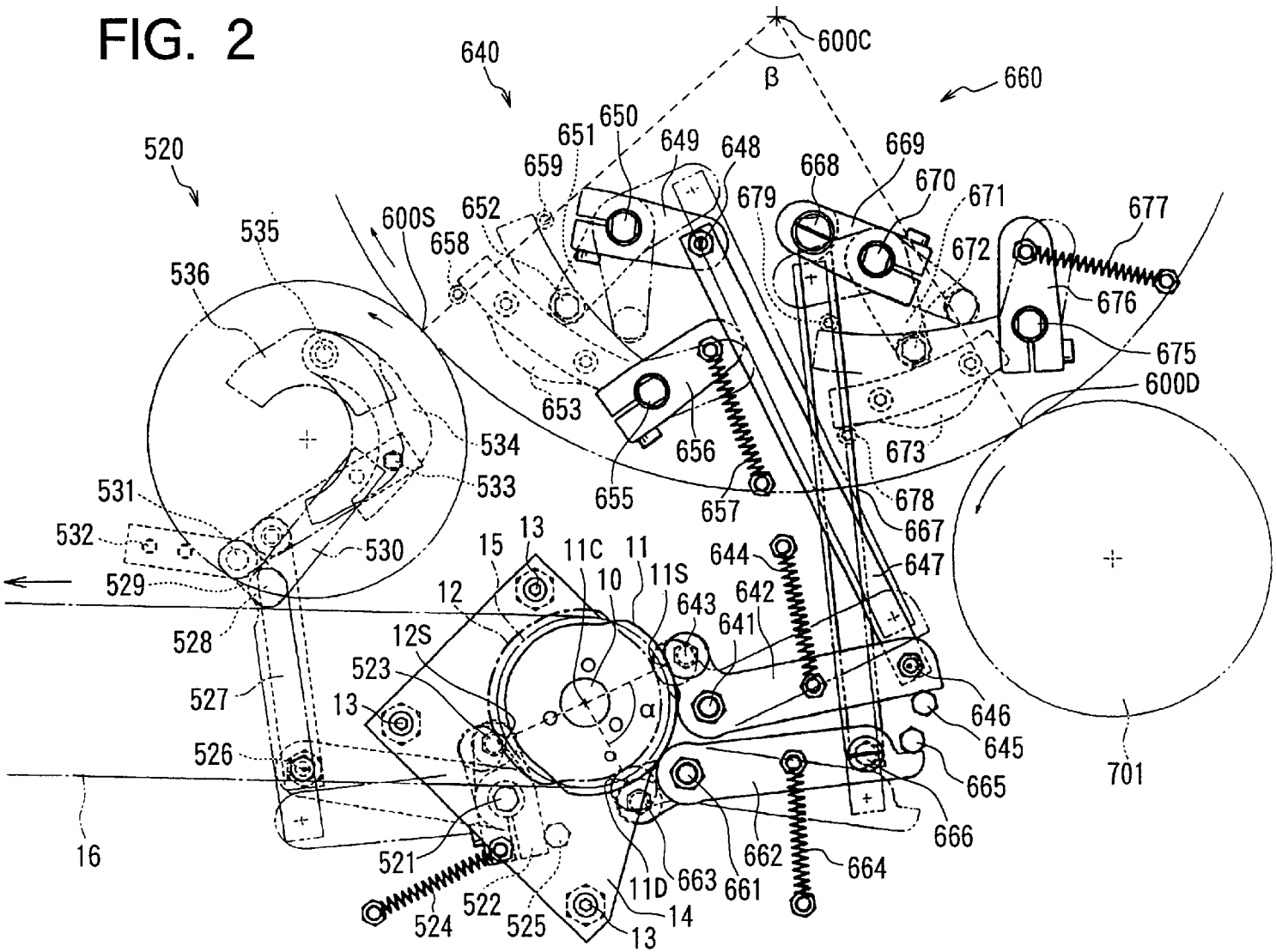
FIG. 2 is a side view opposite the side of FIG. 1 showing detail of a sheet feed cylinder gripper drive mechanism, a sheet feed side impression cylinder gripper drive mechanism, and a sheet discharge side impression cylinder gripper drive mechanism according to the embodiment.
Figure 3:
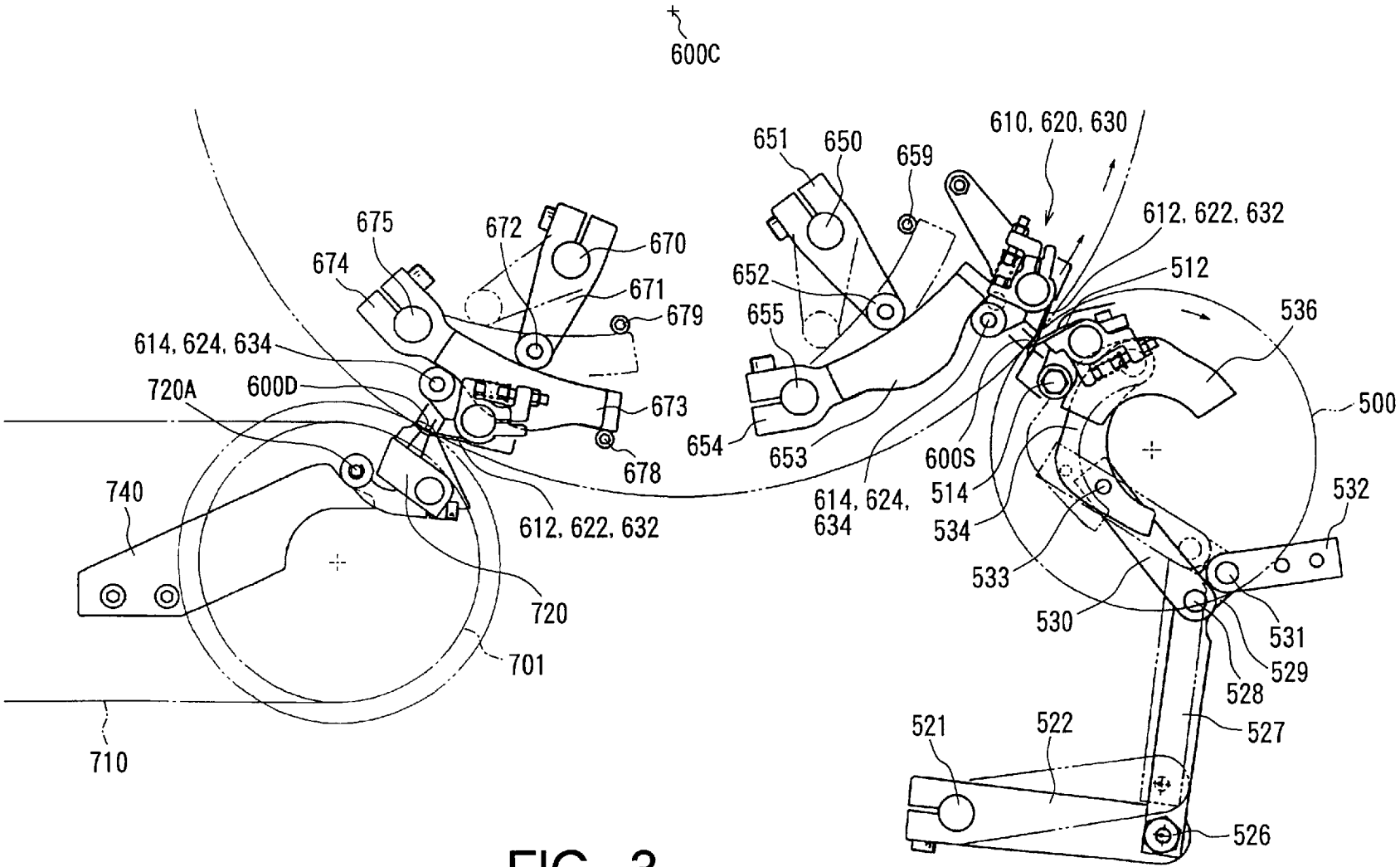
FIG. 3 is a side view showing a positional relationship among a sheet feed cylinder gripper, an impression cylinder gripper, sheet discharge grippers, the sheet feed cylinder gripper drive mechanism, the sheet feed side impression cylinder gripper drive mechanism, the sheet discharge side impression cylinder gripper drive mechanism, and a sheet discharge gripper cam which serves as a sheet discharge gripper drive mechanism in the offset printing machine according to the embodiment.

FIGS. 2 to 6 show configuration of a sheet feed cylinder gripper drive mechanism 520, a sheet feed side impression cylinder gripper drive mechanism 640, a sheet discharge side impression cylinder gripper drive mechanism 660, and a sheet discharge gripper drive mechanism or a drive cam 740. The sheet feed cylinder gripper drive mechanism 520 is for switching the sheet feed cylinder gripper 510 between its open condition and the closed condition near the contact position 600S. The sheet feed side impression cylinder gripper drive mechanism 640 is for switching the impression cylinder grippers 610, 620, 630 between the open condition and the closed condition near the contact position 600S. The sheet discharge side impression cylinder gripper drive mechanism 660 is for switching the impression cylinder grippers 610, 620, 630 between the open condition and the closed condition near the sheet discharge position 600D. The sheet discharge gripper cam 740 serves as a mechanism for opening and closing the sheet discharge gripper 720,730 to switch the sheet discharge grippers 720, 730 between their open and closed conditions near the sheet discharge position 600D. FIG. 2 is a view taken from the opposite side of the view shown in FIG. 1. FIG. 3 is a detail of the view shown in FIG. 1 for particularly showing these mechanisms.

As shown in FIGS. 2 and 4, first and second sheet feed/discharge drive cams 11, 12 are fixed on a shaft 10 rotatably supported on the frame 3. The first and second sheet feed/discharge drive cams 11, 12 are aligned in a row parallel with the axial direction of the shaft 10. The first feed/discharge drive cam 11 is formed with a protruding cam surface following 180-degree range, which corresponds to 360 degrees divided by a number of color sections of each blanket cylinder. The remaining surface of the first feed/discharge drive cam 11 is formed with a cutout cam surface. The second feed/discharge drive cam 12 is formed with a cutout cam surface following 180-degree range, which corresponds to 360 degrees divided by a number of color sections of each blanket cylinder. The remaining region at the surface of the second feed/discharge drive cam 12 is formed with a protruding cam surface. As viewed in FIG. 2, the first and second sheet feed/discharge drive cams 11, 12 are disposed on the shaft 10 with a symmetric orientation with each other. These first and second sheet feed/discharge drive cams 11, 12 rotate integrally with the shaft 10 about an axis of the shaft 10. That is, the protruding cam surface of the first feed/discharge drive cam 11 overlaps with the cutout cam surface of the second feed/discharge drive cam 12, and the cutout surface of the first feed/discharge drive cam 11 overlaps with the protruding cam surface of the second feed/discharge drive cam 12 and this mutual positional relationship is maintained unchanged. A pulley 15 is fixedly mounted on the shaft 10 and the belt 16 is mounted over the pulley 15 to supply with power for rotating the first and second sheet feed/discharge drive cams 11, 12. The pulley 15 and the belt 16 are provided for rotating the first and second sheet feed/discharge drive cams 11 and 12 in a counter clockwise direction as viewed in FIG. 2 at a rotational speed of one rotation for every two thirds rotation of the impression cylinder 600, that is, for every two rotations of the sheet feed cylinder 500, that is, (every number of color sections in the blanket cylinder)/(number of segments in the impression cylinder). A stud 13 is provided on the frame 3 and a sub frame 14 is fixed on the frame 3 by the stud 13. The end of the shaft 10 not directly supported by the frame 3 is rotatably supported on the sub frame 14. This prevents the shaft 10 from its vibration during printing operations.

Next, details of the sheet feed cylinder gripper drive mechanism 520 will be described. As described above, this mechanism is adapted is for switching the sheet feed cylinder gripper 510 between its open condition and closed condition near the contact position 600S. A shaft 521 is fixed to the frame 3 as shown in FIG. 4, and an arm 522 is provided pivotable about the shaft 521. The arm 522 includes a head portion 522A and a leg portion 522B. A cam follower 523 is provided on one end of the head portion 522A, and the cam follower 523 is in contact with the second feed/discharge drive cam 12. One end of a spring 524 is connected to another end of the head portion 522A and another end of the spring 524 is fixed to the frame 3. The spring 524 urges the cam follower 523 toward the second feed/discharge drive cam 12. The other end of the head portion 522A is provided abutable with an eccentric stud 525, protruding from the frame 3 and positioned opposite to the spring 524 with respect to the other end of the head portion 522A. The eccentric stud 525 prevents the arm 522 from rotating excessively in the counter clockwise direction as viewed in FIG. 2.

An eccentric pin 526 is rotatably provided on the leg portion 522B. One end of a link 527 is pivotably connected on the eccentric pin 526. A pin 528 is provided on another end of the link 527. One end of links 529, 530 are pivotably connected to the pin 528. A bracket 532 (FIG. 5) is fixed on the frame 3, and a pin 531 is provided on the bracket 532. Another end of the link 529 is pivotably connected on the pin 531. Further, the fixed cam 536 is fixed on the frame 3. The movable cam 534 is provided pivotably about a pin 535 fixed to a bracket 537. A pin 533 is provided on another end of the link 530. The movable cam 534 is pivotably connected with respect to the pin 533.

A set of the movable cam 534 and the fixed cam 536 are provided in a superposed relation in the axial direction of the sheet feed cylinder 500. The cam follower 514 of the sheet feed cylinder gripper 510 abuts against the cam surface of these cams 534, 536 for opening and closing the sheet feed cylinder gripper 510. The fixed cam 536 is adapted to switch the sheet feed cylinder gripper 510 to its open condition directly after the sheet feed cylinder gripper 510 reaches the contact position 600S and to switch the sheet feed cylinder gripper 510 back to its closed condition directly after the opening movement. The movable cam 534 is adapted to switch the sheet feed cylinder gripper 510 into its open condition before the sheet feed cylinder gripper 510 reaches the contact position 600S.

When the cam follower 523 contacts the protruding cam surface of the second feed/discharge drive cam 12, the sheet feed cylinder gripper drive mechanism 520 is positioned indicated by a two-dot chain line in FIG. 2 and by a solid line in FIG. 3. That is to say, the arm 522 pivots about the pin 521 in the counter clockwise direction in FIG. 2 so that the link 527 moves downward in FIG. 2. Therefore, the movable cam 534 pivots about the pin 535 via the link 530 in the clockwise direction in FIG. 2. As a result, the movable cam 534 moves to the position away from the impression cylinder 600. In this position the cam follower 514 of the sheet feed cylinder gripper 510 can not abut against the movable cam 534 and so only can abut against the fixed cam 536. That is to say, the sheet feed cylinder gripper 510 is maintained at its closed condition due to the movement of the movable cam 534 directly before the sheet feed cylinder gripper 510 reaches the contact position 600S. The sheet feed cylinder gripper 510 is then switched to its open condition by the fixed cam 536 directly after it reaches the contact position 600S.

The sheet feed cylinder gripper drive mechanism 520 is positioned as shown by a broken line in FIG. 2 and in a two dotted chain line in FIG. 3 when the cam follower 523 abuts against the cutout cam surface in the second feed/discharge drive cam 12. That is to say, the arm 522 pivots about the pin 521 in the clockwise direction in FIG. 2 so that the link 527 moves upward in FIG. 2. Thus, the movable cam 534 pivots about the pin 535 via the link 530 in the counter clockwise direction in FIG. 2. As a result, the movable cam 534 moves toward the impression cylinder 600 and to a proximity position. At this proximity position, the cam follower 514 can abut against both the movable cam 534 and the fixed cam 536. That is to say, the sheet feed cylinder gripper 510 is switched to its open condition because of the movement of the movable cam 534 to the proximity position, directly before the sheet feed cylinder gripper 510 reaches the contact position 600S. The sheet feed cylinder gripper 510 is then maintained in its open position by the fixed cam 536 directly after reaching the contact position 600S.

The second feed/discharge drive cam 12 is formed with the cutout cam surface around 180 degrees of its periphery and rotates once each time the sheet feed cylinder 500 rotates twice. Therefore, the movable cam 534 is maintained at its spaced away position when the sheet feed cylinder 500 rotates once, and then maintained in its position near the proximity position when the sheet feed cylinder 500 rotates again. These two operations are repeated each time the sheet feed cylinder 500 rotates twice. That is, each time the two segments of the segments 600*a*, 600*b*, 600*c* pass by the contact position 600S.

Next, will be described details of the sheet feed side impression cylinder gripper drive mechanism 640, which is for switching the impression cylinder grippers 610, 620, 630 between their open conditions and their closed conditions at a position near the contact position 600S. As shown in FIG. 4, the stud 641 is fixed on the frame 3, and a corner portion of an L shaped arm 642 is pivotably connected to the stud 641. A cam follower 643 for abutting against the first feed/discharge drive cam 11 is provided on a free end of a first arm portion of the arm 642. One end of a spring 644 for urging the cam follower 643 toward the first feed/discharge drive cam 11 is connected to a second arm portion of the arm 642 at a position opposite the cam follower 644 with respect to the stud 641. Another end of the spring 644 is connected to the frame 3. The second arm portion of the arm 642 is abuttable on an eccentric stud 645 protruding from the frame 3 at a position opposite the spring 644 with respect to the arm 642. The stud 645 prevents the arm 642 from pivoting excessively about the stud 641 in the clockwise direction in FIG. 2.

A pin 646 is provided at a free end of the second arm portion of the arm 642. One end of a link 647 is pivotably connected to the pin 646. A pin 648 is connected to another end of the link 647 and an end of an arm 649 is pivotably connected to the pin 648. Another end of the arm 649 is integrally connected to a shaft 650 (FIG. 4) rotatably supported to the frame 3, so that the arm 649 is pivotable about an axis of the shaft 650. An end of an arm 651 is also integrally connected to the shaft 650. Thus, the arms 649 and 651 are pivotally moved integrally with each other.

A biasing roller 652 is provided on another end of the arm 651, and a movable grip switching cam 653 is provided pivotably on the frame 3 at a position where the cam 653 can abut against the biasing roller 652. The grip switching cam 653 has one end integrally connected with a cam arm 654 as shown in FIGS. 3 and 4. The cam arm 654 is integrally connected with a shaft 655 rotatably supported on the frame 3. Thus, the grip switching cam 653 and the cam arm 654 are pivotable about an axis of the shaft 655. One end of an arm 656 is integrally connected with the shaft 655 at a position opposite the cam arm 654 with respect to the frame 3. Thus, the grip switching cam 653, the dam arm 654, and the arm 656 are pivotable integrally with each other. Another end of the arm 656 is connected to a spring 657 which is fixed on the frame 3. The spring 657 urges the grip switching cam 653 in a direction away from the sheet feed cylinder 500, that is, in a clockwise direction about the axial center of the shaft 655 in FIG. 2. The biasing roller 652 constantly abuts against one side cam surface of the grip switching cam 653. Two socket bolts 658, 659 protrude from the frame 3 and are abutable with a free end of the grip switching cam 653 to define the pivoting range of the grip switching cam 653. Because the free end of the grip switching cam 653 is positioned between the two socket bolts 658, 659, the grip switching cam 653 can be prevented from its excessive pivotal movement.

The grip switching cam 653 is provided in superposed relation with the impression cylinder 600 in its axial direction. The grip switching cam 653 is adapted for opening and closing the impression cylinder grippers 610, 620, 630 when the cam followers 614, 624, 634 abut against the cam surface of the grip switching cam 653. The grip switching cam 653 is for switching the impression cylinder grippers 610, 620, 630 at a proximity position described later into the open conditions immediately before the impression cylinder grippers 610, 620, 630 reach the contact position 600S, and then into the closed condition.

The sheet feed side impression cylinder gripper drive mechanism 640 is positioned as indicated by dotted line in FIG. 2 and a solid line in FIG. 3 when the cam follower 643 contacts the protruding cam surface of the first feed/discharge drive cam 11. That is to say, the arm 642 pivots about the stud 641 in the clockwise direction in FIG. 2 so that the link 647 moves downward in FIG. 2. The arms 649, 651 pivot integrally together in the clockwise direction about the axis of the shaft 650 in FIG. 2. By this pivoting movement, the biasing roller 652 of the arm 651 pivots the grip switching cam 653 in the counter clockwise direction in FIG. 2 against the biasing force of the spring 657 so that the grip switching cam 653 moves toward the proximity position, i.e., near the outer peripheral surface of the sheet feed cylinder 500. At this proximity position, the cam followers 614, 624, 634 of the impression cylinder grippers 610, 620, 630 are abutable with the grip switching cam 653. That is to say, the impression cylinder grippers 610, 620, 630 are switched into their open conditions immediately before they reach the contact position 600S because of the movement of the grip switching cam 653 toward the proximity position, and then switched into their closed condition directly after they reach the contact position 600S.

The sheet feed side impression cylinder gripper drive mechanism 640 is positioned as shown in two dotted chain line in FIGS. 2 and 3 when the cam follower 643 is brought into contact with the cutout cam surface of the first feed/discharge drive cam 11. That is to say, the arm 642 pivots about the stud 641 in the counter clockwise direction in FIG. 2 so that the link 647 moves upward in FIG. 2. The arms 649 and 651 pivot integrally together in the counter clockwise direction in FIG. 5. By this pivoting movement, the biasing roller 652 on the arm 651 moves in the direction away from the grip switching cam 653. The urging force of the spring 657 pivots the grip switching cam 653 in the clockwise direction in FIG. 2 in the position away from the peripheral surface of the sheet feed cylinder 500, i.e., away from the proximity position. In this position, the cam follower 614, 624, 634 of the impression cylinder grippers 610, 620, 630 cannot abut against the grip switching cam 653. That is to say, the impression cylinder grippers 610, 620, 630 are maintained at their closed conditions from directly before to directly after they reach the contact position 600S because the cam follower 614, 624, 634 do not abut against the grip switching cam 653.

In the same manner as the second feed/discharge drive cam 12, the first feed/discharge drive cam 11 rotates once each time the sheet feed cylinder 500 rotates twice. Because the first feed/discharge drive cam 11 is formed with the cutout cam surface portion around 180 degrees angle of its outer periphery, the grip switching cam 653 is maintained at its proximity position while the sheet feed cylinder 500 rotates once and then maintained spaced away from the sheet feed cylinder 500 when the sheet feed cylinder 500 rotates for second time. This cycle is repeated each time the sheet feed cylinder 500 rotates twice.

Next, the sheet discharge side impression cylinder gripper drive mechanism 660 for switching the impression cylinder grippers 610, 620, 630 between their open conditions and their closed conditions when the grippers approach the sheet discharge position 600D between the impression cylinder 600 and the sheet discharge mechanism 700. The sheet discharge side impression cylinder gripper drive mechanism 660 has the same configuration as the sheet feed side impression cylinder gripper drive mechanism 640. The components of the sheet discharge side impression cylinder gripper drive mechanism 660 that correspond to the components of the sheet feed side impression cylinder gripper drive mechanism 640 are shown in FIGS. 2 to 5 with the same numbering incremented by 20. The sheet discharge side impression cylinder gripper drive mechanism 660 is driven by the rotation of the first feed/discharge drive cam 11.

The cam follower 614, 624, 634 of the impression cylinder grippers 610, 620, 630 are abuttable on a grip switching cam 673 when the grip switching cam 673 is in its proximity position, i.e., near the outer peripheral surface of the sheet discharge sprocket 701. That is to say, the impression cylinder grippers 610, 620, 630 are maintained in their closed condition from directly before each one reaches the sheet discharge position 600D and then switched to their open condition by the grip switching cam 673 directly after each one reaches the sheet discharge position 600D.

The cam followers 614, 624, 634 cannot abut against the grip switching cam 673 when the grip switching cam 673 is positioned spaced away from the proximity position. That is to say, the impression cylinder grippers 610, 620, 630 are maintained at closed conditions from directly before to directly after the each one reaches the sheet discharge position 600D because the cam followers 614, 624, 634 do not abut against the grip switching cam 673.

Because the first feed/discharge drive cam 11 rotates once each time the sheet feed cylinder 500 rotates twice, and because the first feed/discharge drive cam 11 is formed with the cutout cam surface portion around 180 degrees of its outer surface, the grip switching cam 673 is maintained near the sprocket 701 for a single rotation of the sheet feed cylinder 500 and maintained in its spaced away position for a subsequent single rotation of the sheet feed cylinder 500, and this switching operation is repeated each time the sheet feed cylinder 500 rotates twice.

Next, the sheet discharge gripper cam 740 will be described. The sheet discharge gripper cam 740 is for switching the sheet discharge grippers 720, 730 between their open and closed conditions when they approach the sheet discharge position 600D. As best shown in FIG. 3, the sheet discharge gripper cam 740 is fixed to the frame 3 in a superposed relation with the sprocket 701 in its axial direction. The sheet discharge gripper cam 740 is positioned so that a cam follower 720A of the sheet discharge grippers 720, 730 (the cam follower of the sheet discharge gripper 730 is not shown) can be brought into contact with the sheet discharge gripper cam 740 immediately before the sheet discharge grippers 720, 730 reach the sheet discharge position 600D. The sheet discharge grippers 720, 730, which are normally in their closed position, can be switched to their open condition when the cam follower 720A is brought into abutment with the cam surface of the sheet discharge gripper cam 740, and then are switched immediately back to their closed position.

Next, will be described the relationship between the rotation of the first and second sheet feed/discharge drive cams 11, 12 and moving timings of the movable cam 534 and the grip switching cams 653 and 673. FIG. 2 shows the positional relationship among the contact position 600S between the impression cylinder 600 and the sheet feed cylinder 500, the proximity position 600D between the impression cylinder 600 and the sheet discharge mechanism 700, a contact point 12S between the second feed/discharge drive cam 12 and the cam follower 523, a contact point 11S between the first feed/discharge drive cam 11 and the cam follower 643, and a contact point 11D between the first feed/discharge drive cam 11 and the cam follower 663.

The contact points 11S and 12S are angularly separated by 180 degrees with respect to the center axis 11C of the first and second sheet feed/discharge drive cams 11, 12. The movable cam 534 is held in the position spaced away from the impression cylinder 600 while the cam follower 523 contacts the protruding cam surface of the second feed/discharge drive cam 12. At this time, the cam follower 643 abuts against the protruding cam surface of the first feed/discharge drive cam 11, so that the grip switching cam 653 is maintained at its proximity position near the outer periphery of the sheet feed cylinder 500. With this positional relationship, the sheet feed cylinder gripper 510 is held in its closed condition by the movable cam 534 directly before the sheet feed cylinder gripper 510 reaches the contact position 600S, and is then maintained in its open condition by the fixed cam 536 immediately after the gripper reaches the contact position. On the other hand, the impression cylinder grippers 610, 620, 630 are opened directly before they reach the contact position 600S by the grip switching cam 653, and are then closed directly after they reach the contact position 600S. This results in a sheet transfer operation from the sheet feed cylinder 500 to the impression cylinder 600.

The movable cam 534 is maintained in its proximity position near the impression cylinder 600 while the cam follower 523 abuts against the cutout cam surface of the second feed/discharge drive cam 12. At this time, the cam follower 643 abuts against the cutout cam surface of the first feed/discharge drive cam 11 so that the grip switching cam 653 is maintained at its position spaced away from the outer surface of the sheet feed cylinder 500. With this positional relationship, the sheet feed cylinder gripper 510 is maintained in its open position by the movable cam 534 directly before the sheet feed cylinder gripper 510 reaches the contact position 600S and is brought into its open condition by the fixed cam 536 directly after the sheet feed cylinder gripper 510 reaches the contact position 600S. On the other hand, the impression cylinder grippers 610, 620, 630 are not influenced by the grip switching cam 653 and therefore, are maintained in their closed conditions from directly before to directly after the impression cylinder grippers 610, 620, 630 reach the contact position 600S. As a result, no sheet is transferred from the sheet feed cylinder 500 to the impression cylinder 600.

Figure 7:
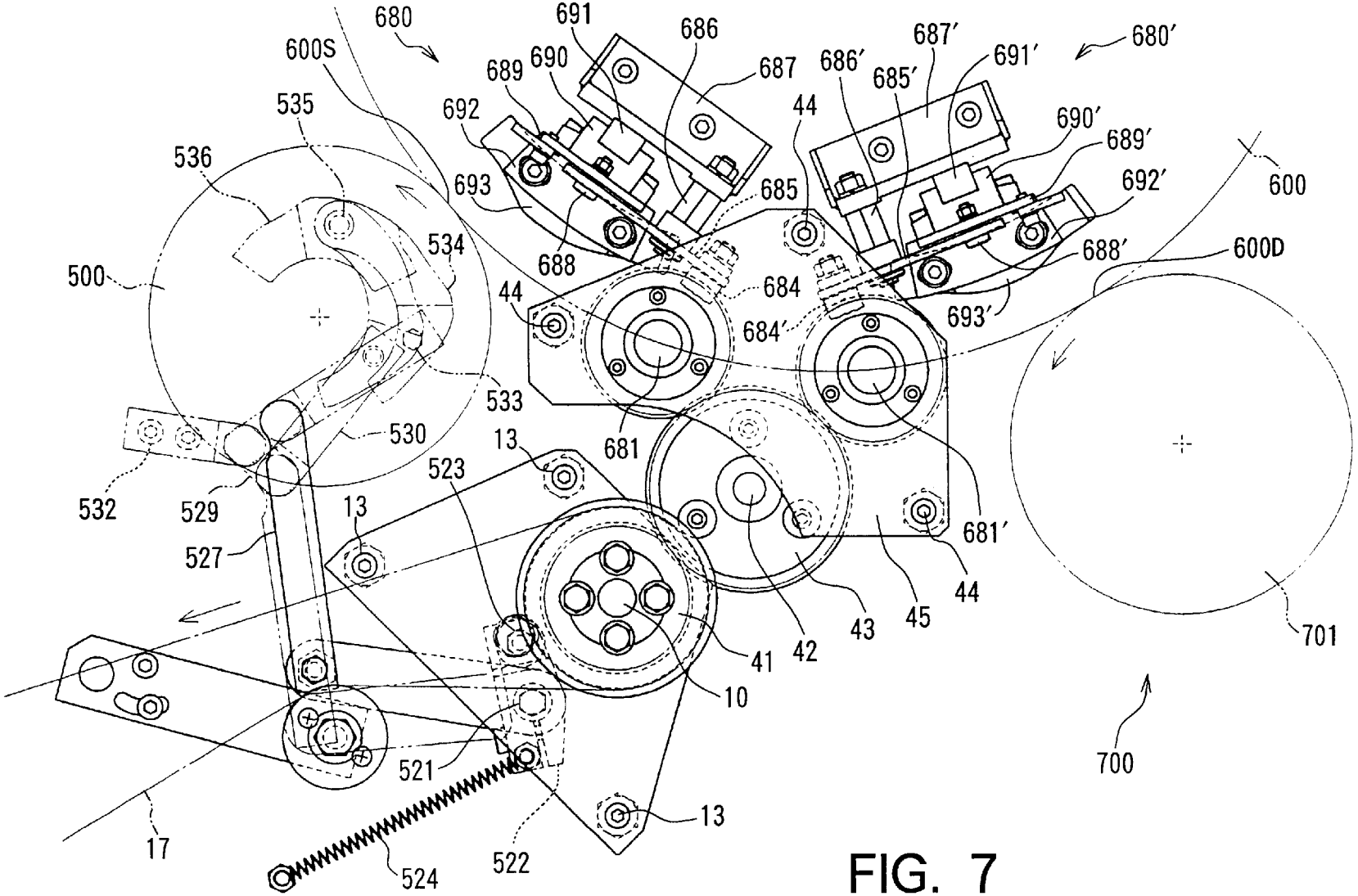
FIG. 7 is a side view showing a sheet feed side impression cylinder gripper drive mechanism and a sheet discharge side impression cylinder gripper drive mechanism of the offset printing machine according to a modified embodiment and as viewed from a position opposite to FIG. 1.

(9) Modified Embodiment of the Sheet Supply Side Impression Cylinder Gripper Drive Mechanism and the Sheet Discharge Side Impression Cylinder Gripper Drive Mechanism FIGS. 7 though 10 show an offset printing machine including a sheet supply side impression cylinder gripper drive mechanism 680 and a sheet discharge side impression cylinder gripper drive mechanism 680' instead of the sheet feed side impression cylinder gripper drive mechanism 640 and the sheet discharge side impression cylinder gripper drivel mechanism 660 of the above described embodiment. The sheet supply side impression cylinder gripper drive mechanism 680 is for switching the impression cylinder grippers 610, 620, 630 between their open and closed conditions near the contact position 600S. The sheet discharge side impression cylinder gripper drive mechanism 680' is for switching the impression cylinder grippers 610, 620, 630 between their open and closed conditions near the proximity position 600D.

In FIGS. 7 through 10, like parts and components other than the sheet supply side impression cylinder gripper drive mechanism 680 and the sheet discharge side impression cylinder gripper drive mechanism 680' are designated by the same reference numerals as those of the above described embodiment In the modification, a sheet feed/discharge drive gear 41 is fixed to the shaft 10 at a position between the frame 3 and the sub frame 14. The drive gear 41 is used instead of the first and second sheet feed/discharge drive cams 11, 12 of the above-described embodiment and is rotatable integrally with the shaft 10. A stud 42 is fixed on the frame 3, and gear 43 is rotatably supported on the stud 42. The gear 43 is meshingly engaged with the sheet feed/discharge drive gear 41 so that rotational force of the sheet feed/discharge drive gear 41 is transmitted to the gear 43. Drive force for driving the driving mechanism 680, 680' is supplied from the shaft 10 through the gear 43.

Figure 8:
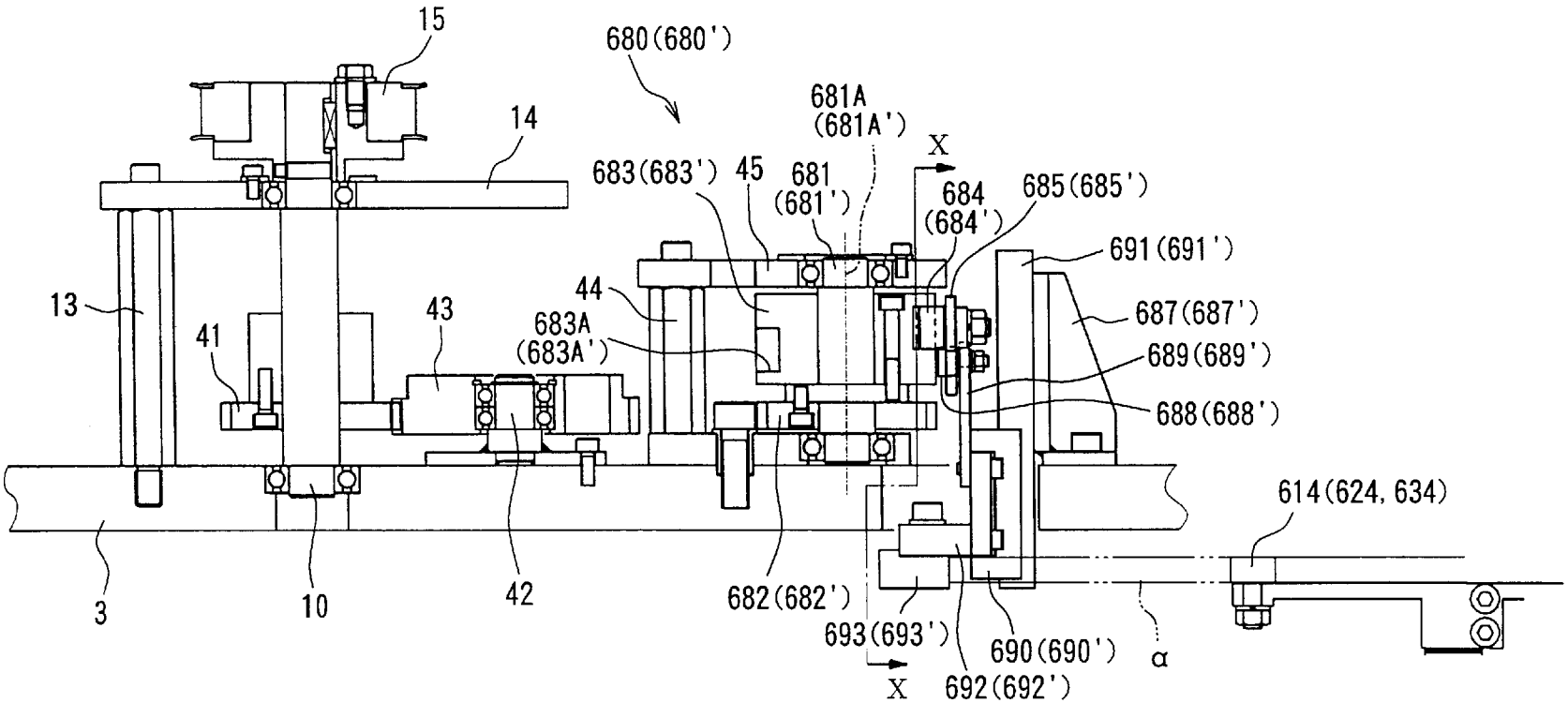
FIG. 8 is a developmental view showing the sheet feed side impression gripper drive mechanism and the sheet discharge side impression cylinder drive mechanism of FIG. 7.
Figure 9:
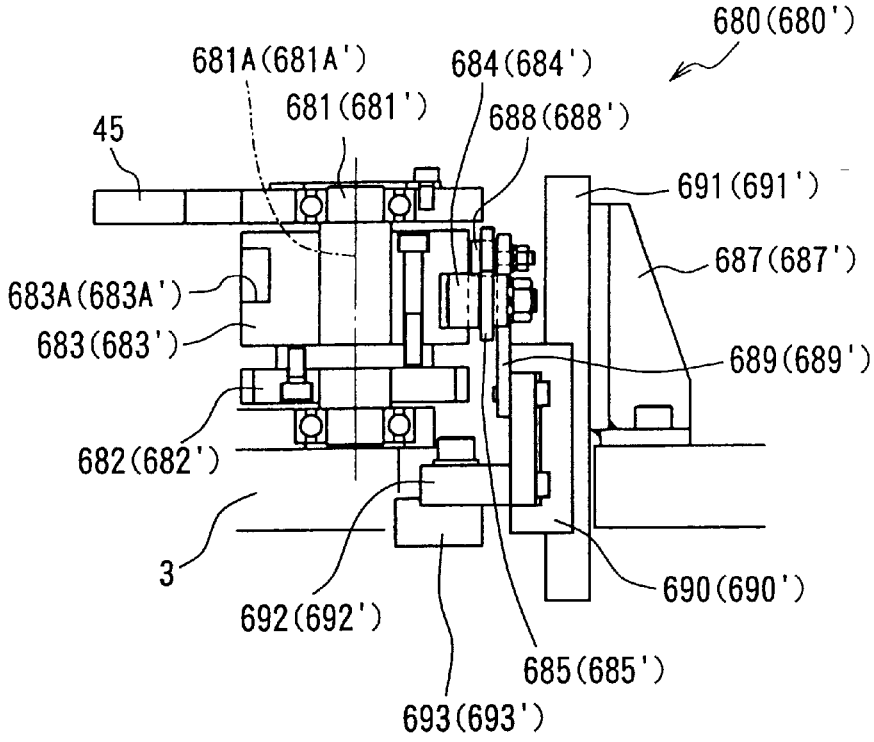
FIG. 9 is a developmental view showing detail of the sheet feed side impression cylinder gripper drive mechanism and the sheet discharge side impression cylinder gripper drive mechanism of FIG. 7.

Next, configuration of the drive mechanism 680 will be described. As shown in FIG. 8, a plate 45 is fixed to the flame 3 via studs 44. A shaft 681 rotatably extends between the frame 3 and the plate 45. A gear 682 meshingly engaged with the gear 43 is fixed on the shaft 681. The gear 682 and the shaft 681 are rotated integrally together by the rotational force transmitted from the shaft 10. A grooved cam 683 is fixed on the shaft 681. The grooved cam 683 rotates integrally with the shaft 681 and the gear 682. An annular groove 683A is formed on an outer cam surface of the grooved cam 683. As shown in FIGS. 8 and 9, the annular groove 683A is slantingly formed with respect to an axial center 681A of the shaft 681. The portion of the annular groove 683A that is farthest from the frame 3, that is, the portion to the right of the shaft 681 as viewed in FIG. 8 and the portion to the left of the shaft 681 as viewed in FIG. 9, will be referred to as an "upper position" hereinafter. The portion of the annular groove 683A that is nearest the frame 3, that is, the portion to the left of the shaft 681 as viewed in FIG. 8 and the portion to the right of the shaft 681 as viewed in FIG. 9, will be referred to as a "lower position" hereinafter.

A roller 684 is fitted in the annular groove 683A. The roller 684 is formed to match the annular groove 683A in the depthwise direction of the annular groove 683A and the axial direction of the axis 681A. One end of an arm 685 is connected to the roller 684.

A stud 687 is fixed to the frame 3, and a rail 691 protruding perpendicular to the frame 3 is fixed to the stud 687. A guide 690 is fitted in the rail 691 and is slidably movable in a direction in which the rail 691 extends. A bracket 689 is fixed on the guide 690. A roller 688 is fixed on the bracket 689 and is connected to another end of the arm 685. A support pin 686 is fixed on the stud 687, and an intermediate portion of the arm 685 is pivotally supported to the support pin 686. The arm 685 is pivotally movable about the support pin 686 by the displacement of the roller 684.

A bracket 692 is fixed on the bracket 689, and a grip switching cam 693 is fixed on the bracket 692. The grip switching cam 693 has a cam surface with the same shape as the grip switching cam 653 of the drive mechanism shown in FIG. 2.

Next, operation of the drive mechanism 680 will be described. Rotational force of the shaft 10 is transmitted to the grooved cam 683 through the drive gear 41, the gears 43 and 682, and the shaft 681. As a result, the annular groove 683A rotates in association with the rotation of the grooved cam 683.

Figure 10:
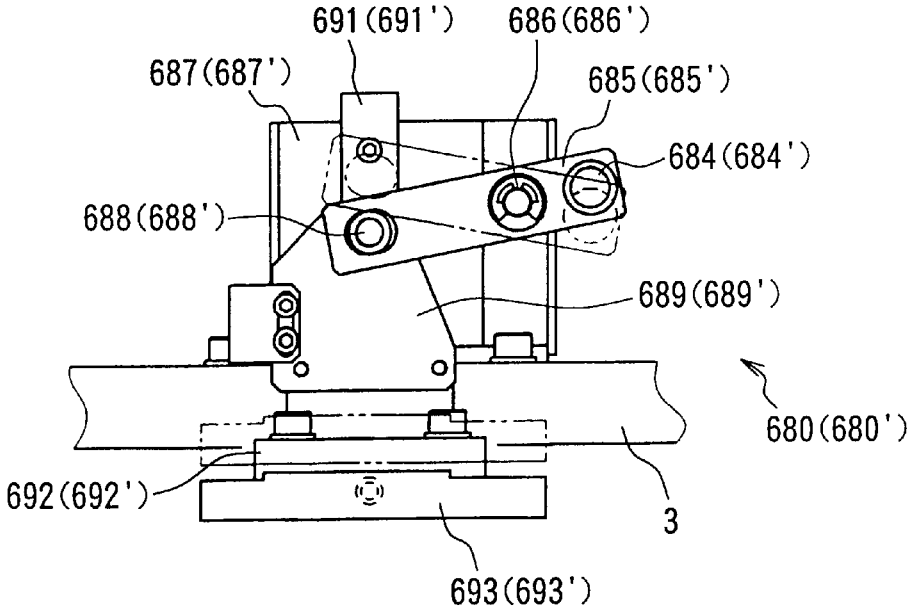
FIG. 10 is a front view for description of movement of grip switching cams of the sheet feed impression cylinder gripper drive mechanism and the sheet discharge side impression cylinder gripper drive mechanism of FIG. 7.

When the roller 684 is in its upper position as shown in FIG. 8 in accordance with the rotation of the annular groove 683A, the arm 685 pivots in counter clockwise direction in FIG. 10, so that the roller 688 moves to its lower position, whereupon the bracket supporting the roller 688 and the bracket 692 are also moved downward in FIG. 10 together with the grip switching cam 693. In this position, the cam followers 614, 624, 634 of the impression cylinder grippers 610, 620, 630 are abuttable on the grip switching cam 693 as shown in FIG. 8. Accordingly, the impression cylinder grippers 610, 620, 630 reaching the contact position 600S is switched into the open condition by the grip switching cam 693. Incidentally in FIG. 8, the two-dotted chain line α indicates that the grip switching cam 693 and the cam follower 614 (624, 634) are located at the same height so that they are abutable with each other.

When the roller 684 is at its lower position in accordance with the rotation of the annular groove 683A as shown in FIG. 9, the arm 685 pivots in the clockwise direction in FIG. 10, so that the roller 688 moves to its upper position. The brackets 689 and 692 are moved upward in FIG. 10 together with the grip switching cam 693 into the posture indicated in FIG. 10 by two dotted chain line. At this position, the grip switching cam 693 can no longer abut against the cam followers 614, 624, 634. Accordingly, the impression cylinder grippers 610, 620, 630 whichever is near the contact position 600S will remain in its closed condition.

In the same manner as the above-described embodiment, the shaft 10 rotates once each time the sheet feed cylinder 500 rotates twice. Therefore, the grooved cam 683 also rotates once each time the sheet feed cylinder rotates twice. Thus, the roller 684 moves reciprocally up and down one time each time the sheet feed cylinder 500 rotates twice. As a result, when the roller 684 is in its upper position at the first rotation of the sheet feed cylinder 500 for example, then the roller 684 will move to its lower position when the sheet feed cylinder 500 is at its second rotation. This reciprocal vertical movement is repeated each time the sheet feed cylinder 500 rotates twice. One of the impression cylinder grippers 610, 620, 630 passes by the contact position 600S every time the sheet feed cylinder 500 rotates once. As a result, the impression cylinder grippers 610, 620, 630 alternatively driven into open condition and closed condition as they pass by the contact position 600S.

The configuration and operation of the drive mechanism 680' is absolutely the same as the drive mechanism 680. Members of the drive mechanism 680' are referred to with the same numbering as the members of the drive mechanism 680 but include "'" symbol as shown in FIG. 7.

(10) Others

While the invention has been described in detail and with reference to the specific embodiments thereof, it would be apparent to those skilled in the art that various changes and modifications may be made therein without departing from the spirit and scope of the invention.

For example, the offset printing machine in the embodiment is for printing in four different colors of ink, and includes two blanket cylinders and two plate cylinders, wherein the peripheral surface of each plate cylinder and blanket cylinder is divided into two different color regions or sections. However, a number of different colored inks is not limited to four. Also, a number of blanket cylinders and plate cylinders is not limited to two each. Furthermore, the number of colored regions at outer surface of each plate cylinder and each blanket cylinder is not limited to two each. As long as the number of ink colors is equivalent to (the number of plate cylinders or blanket cylinders) times (the number of color regions on the outer surface of each plate cylinder) then any number of different ink types is conceivable. For example, the six ink types are desired, then for example three plate cylinders can be provided and each plate cylinder can have its outer surface divided into two different colored regions. Alternatively, two plate cylinders are provided and outer surface of each plate cylinder is divided into three colored regions.

According to the present embodiment, the outer periphery of each impression cylinder is divided into three segments. However, any number of segments can be provided to the outer surface in the impression cylinder as long as the number is relatively prime with respect to the number of colored regions on the outer surface of a single blanket cylinder, or a single plate cylinder. As long as the number of segments provided on the outer surface of the impression cylinder is relatively prime with respect to the number of colored region at the outer surface of a single plate cylinder or blanket cylinder, then the ink images of all different color types can be printed on a single sheet supported at the outer periphery surface of the impression cylinder.

Further, in the embodiment, the outer peripheral length of the sheet feed cylinder is equal to the outer peripheral length of each color section on the blanket cylinder. However, it is sufficient if the outer peripheral length of the sheet feed cylinder is integral multiple of the peripheral length of the color section. In this case, the outer peripheral surface of the sheet feed cylinder is divided into equivalent segments having a length equal to the peripheral length of each colored section on the blanket cylinder and the sheet feed cylinder grippers are provided at a leading edge of each segment. Further, if the outer peripheral length of the sheet feed cylinder can be made equal to the outer peripheral length of the blanket cylinder, or if the outer peripheral length of the sheet feed cylinder is integral multiple of the peripheral length of the color section, only the sheet feed cylinder gripper fixed cam 536 needs to be provided instead of the sheet feed cylinder gripper drive mechanism 520.

Further, the mechanism with the same configuration as the sheet feed cylinder and the sheet feed cylinder gripper drive mechanism of the embodiment can be used as the sheet discharge mechanism instead of the above described sheet discharge mechanism 700. In this case, a mechanism with the same configuration as the sheet feed cylinder 500 and the sheet feed cylinder gripper drive mechanism 520 shown in FIGS. 2 through 5 can be positioned at the position of the sheet discharge bracket 701. The sheet feed cylinder 500 can function as a sheet discharge cylinder and the sheet feed cylinder gripper drive mechanism 520 can function as a sheet discharge gripper drive mechanism.

What is claimed is:

1. An offset printing machine for forming an image on a sheet comprising:

a plate cylinder rotatable about its axis and having an outer peripheral surface equally divided in a circumferential direction into at least two color regions, an ink image being formed on each color region, each color region having an equal circumferential length;

a blanket cylinder rotatable about its axis and having an outer peripheral surface in contact with the color regions and equally divided in a circumferential direction into at least two color sections, each ink image on each color region being transferred to each color section, and each color section having an equal circumferential length;

an impression cylinder rotatable about its axis and having an outer peripheral surface for holding and transferring a sheet, each color section being in contact with the outer peripheral surface of the impression cylinder so as to be capable of transferring each ink image on each color section onto the sheet, the outer peripheral surface of the impression cylinder being equally divided into a plurality of segments each having a peripheral length equal to the circumferential length of the color region and the color section;

impression cylinder grippers provided at the outer peripheral surface of the impression cylinder and movable along with the rotation of the impression cylinder, each impression cylinder gripper being positioned at each leading end portion of each segment, and each impression cylinder gripper being movable between an open position and a closed position;

a sheet feed cylinder rotatable about its axis and having an outer peripheral surface on which a sheet is capable of being held and transferred and in contact with the outer peripheral surface of the impression cylinder at a contact position for transferring the sheet to the impression cylinder, the outer peripheral surface of the sheet feed cylinder having a peripheral length equal to a peripheral length of each of the segments;

a sheet feed cylinder gripper provided at the outer peripheral surface of the sheet feed cylinder and movable along with the rotation of the sheet feed cylinder, the sheet feed cylinder gripper and one of the impression cylinder grippers being so positioned to simultaneously reach the contact position, the sheet feed cylinder gripper being movable between an open position and a closed position;

a sheet feed side impression cylinder gripper drive mechanism for moving the impression cylinder gripper to either its open position or closed position at the contact position; and a sheet feed cylinder gripper drive mechanism for moving the sheet feed cylinder gripper to either its open position or closed position, wherein a combination of the sheet feed side impression cylinder gripper drive mechanism and the sheet feed cylinder gripper drive mechanism comprise means for providing a sheet transfer timing, when the sheet feed cylinder gripper holds a sheet to be transferred, by switching the impression cylinder gripper from its open position to its closed position and by switching the sheet feed cylinder gripper from its closed position to its open position at a predetermined timing of confrontation between the impression cylinder gripper and the sheet feed cylinder gripper at the contact position, the predetermined confronting timing occurring when the confronting times per sheet printed is equal to the number of the color sections of the blanket cylinder, and wherein, when the sheet feed cylinder gripper does not hold a sheet to be transferred, the sheet feed side impression cylinder gripper drive mechanism comprises means for maintaining the closed position of the impression cylinder gripper when the impression cylinder gripper passes by the contact position, and the sheet feed cylinder gripper drive mechanism comprises means for maintaining the open position of the sheet feed cylinder gripper when the sheet feed cylinder gripper passes by the contact portion, a combination of the maintaining means of the sheet feed side impression cylinder gripper drive mechanism and the maintaining means of the sheet feed cylinder gripper drive mechanism constituting the providing means.

2. The offset printing machine as claimed in claim 1, further comprising a sheet discharge mechanism for receiving a sheet from the impression cylinder at a sheet discharge position comprising:

two sprockets rotatable about their axes extending in a direction parallel with the axis of the impression cylinder;

endless chain mounted on the sprockets and movable by the rotation of the sprockets;

at least two sheet discharge grippers fixed to the endless chain and equi-distantly spaced away from each other, each of the discharge grippers being movable between its open position for receiving and releasing a sheet and closed position for holding a sheet.

3. The offset printing machine as claimed in claim 2, wherein the at least two sheet discharge grippers and the impression cylinder grippers provide a positional relationship so that one of the impression cylinder grippers is in confrontation with one of the sheet discharge grippers at a predetermined timing occurring at every predetermined numbers of arrival of any one of the impression cylinder grippers to the sheet discharge position, the predetermined number being equal to the number of color sections of the blanket cylinder.

4. The offset printing machine as claimed in claim 3, further comprising:

a sheet discharge side impression cylinder gripper drive mechanism for moving each one of the impression cylinder grippers between its open position and closed position at a sheet discharge position; and a sheet discharge gripper driving mechanism for moving each one of the sheet discharge grippers between its open position and closed position at the sheet discharge position, the sheet discharge side impression cylinder gripper drive mechanism comprising means for maintaining the closed position of the impression cylinder gripper when the impression cylinder gripper passes by the sheet discharge position provided that any one of the sheet discharge gripper is positioned offset from the sheet discharge position.

5. The offset printing machine as claimed in claim 4, further comprising:

a feeder board in a form of a belt conveyor for feeding a sheet to the sheet feed cylinder;

a swing mechanism provided adjacent the sheet feed cylinder and moveable to a sheet transferring position where the sheet is transferred from the feeder board to the sheet feed cylinder gripper when the sheet feed cylinder gripper reaches the sheet transferring position, the swing mechanism providing a cyclic period for transferring the sheet from the feeder board to the sheet feed cylinder gripper, the cyclic period being substantially equal to a rotation period of a plurality of times of rotation of the sheet feed cylinder, the plurality of times being equal to the number of color regions.

6. An offset printing machine for forming an image on a sheet comprising:

a frame;

a plate cylinder supported by the frame and rotatable about its axis and having an outer peripheral surface equally divided in a circumferential direction into at least two color regions, an ink image being formed on each color region, each color region having an equal circumferential length;

a blanket cylinder supported by the frame and rotatable about its axis and having an outer peripheral surface in contact with the color regions and equally divided in a circumferential direction into at least two color sections, each ink image on each color region being transferred to each color section, and each color section having an equal circumferential length;

an impression cylinder supported by the frame and rotatable about its axis and having an outer peripheral surface on which the sheet is held and transferred, each color section being in contact with the outer peripheral surface of the impression cylinder for transferring each ink image on each color section onto the sheet, the outer peripheral surface of the impression cylinder being equally divided into a plurality of segments each having a peripheral length equal to the circumferential length of the color region and the color section;

impression cylinder grippers provided at the outer peripheral surface of the impression cylinder and movable along with the rotation of the impression cylinder, each impression cylinder gripper being positioned at each leading end portion of each segment, and each impression cylinder gripper being movable between an open position and a closed position;

a sheet feed cylinder rotatable about its axis and having an outer peripheral surface on which a sheet is held and transferred and in contact with the outer peripheral surface of the impression cylinder at a contact position for transferring the sheet to the impression cylinder, the outer peripheral surface of the sheet feed cylinder having a peripheral length equal to a peripheral length of each of the segments;

a sheet feed cylinder gripper provided at the outer peripheral surface of the sheet feed cylinder and movable along with the rotation of the sheet feed cylinder, the sheet feed cylinder gripper and one of the impression cylinder grippers being so positioned to simultaneously reach the contact position, the sheet feed cylinder gripper being movable between an open position and a closed position;

a sheet feed side impression cylinder gripper drive mechanism for moving the impression cylinder gripper to either its open position or closed position at the contact position; and a sheet feed cylinder gripper drive mechanism for moving the sheet feed cylinder gripper to either its open position or closed position;

the sheet feed side impression cylinder gripper drive mechanism comprising:

a cam shaft rotatably supported by the frame, and rotated once each time the impression cylinder rotates a predetermined number which is the number of the color sections divided by the number of the segments;

a first cam provided integrally with the cam shaft and rotatable together with the cam shaft, the first cam having a front half first cam surface area and a rear half second cam surface area;

a first grip switching cam supported to the frame and movable between an abutment position abuttable on the impression cylinder grippers for moving the impression cylinder grippers from their closed position to their open position and then to the closed position when each one of the impression cylinder grippers passes by the contact position and non-abutment position spaced away from the impression cylinder grippers for maintaining the impression cylinder grippers to their closed position; and a first link mechanism having one end in contact with the first cam and movable in accordance with a contour of the first cam and having another end connected to the first grip switching cam for moving the first grip switching cam between the abutment position and the non-abutment position, the abutment position being provided by the contact of the one end with the first cam surface area, and the non-abutment position being provided by the contact of the one end with the second cam surface area, and, the sheet feed cylinder gripper drive mechanism comprising:

a second cam provided integrally with the cam shaft and rotatable together with the cam shaft, the second cam having a front half cam surface area and a rear half cam surface area, the front half cam surface area being superposed with the second cam surface area of the first cam and the rear half cam surface area being superposed with the first cam surface area of the first cam;

a second grip switching cam supported on the frame and movable between an abutment position abuttable on the sheet feed cylinder gripper for moving the sheet feed cylinder gripper from its closed position to its open position when the sheet feed cylinder gripper passes by the contact position and a non-abutment position spaced away from the sheet feed cylinder gripper for maintaining the sheet feed cylinder gripper in its closed position;

a fixed cam fixed to the frame and positioned downstream of the second grip switching cam with respect to a rotational direction of the sheet feed cylinder, the sheet feed cylinder gripper being abutable on the fixed cam for providing open position of the sheet feed cylinder gripper; and, a second link mechanism having one end in contact with the second cam and movable in accordance with a contour of the second cam and having another end connected to the second grip switching cam for moving the second grip switching cam between the abutment position and the non-abutment position, the abutment position being provided by the contact of the one end with the rear half cam surface area, and the non-abutment position being provided by the contact of the one end with the front half cam surface area.

7. The offset printing machine as claimed in claim 6, further comprising a sheet discharge mechanism for receiving a sheet from the impression cylinder at a sheet discharge position comprising:

two sprockets rotatable about their axes extending in a direction parallel with the axis of the impression cylinder;

an endless chain mounted on the sprockets and movable by the rotation of the sprockets;

at least two sheet discharge grippers fixed to the endless chain and equi-distantly spaced away from each other, each of the discharge grippers being movable between its open position for receiving and releasing a sheet and closed position for holding a sheet.

8. The offset printing machine as claimed in claim 7, wherein the at least two sheet discharge grippers and the impression cylinder grippers provide a positional relationship so that one of the impression cylinder grippers is in confrontation with one of the sheet discharge grippers at a predetermined timing occurring at every predetermined number of access of any one of the impression cylinder grippers to the sheet discharge position, the predetermined number being equal to the number of color sections of the blanket cylinder.

9. The offset printing machine as claimed in claim 8, further comprising:

a sheet discharge side impression cylinder gripper drive mechanism for moving each one of the impression cylinder grippers between its open position and closed position at a sheet discharge position; and a sheet discharge gripper driving mechanism for moving each one of the sheet discharge grippers between its open position and closed position at the sheet discharge position;

the sheet discharge side impression cylinder gripper drive mechanism comprising:

a third grip switching cam supported to the frame and movable between an abutment position abuttable on the impression cylinder grippers for moving the impression cylinder grippers from their closed position to their open position when each one of the impression cylinder grippers passes by the sheet discharge position and a non-abutment position spaced away from the impression cylinder grippers for maintaining the impression cylinder grippers to their closed position; and a third link mechanism having one end in contact with the first cam and movable in accordance with a contour of the first cam and having another end connected to the third grip switching cam for moving the third grip switching cam between the abutment position and the non-abutment position, the abutment position being provided by the contact of the one end with the first cam surface area, and the non-abutment position being provided by the contact of the one end with the second cam surface area, whereby the closed position of the impression cylinder gripper is maintained when the impression cylinder gripper passes by the sheet discharge position provided that any one of the sheet discharge gripper is positioned offset from the sheet discharge position.

10. The offset printing machine as claimed in claim 9, further comprising:

a feeder board in a form of a belt conveyor for feeding a sheet to the sheet feed cylinder;

a swing mechanism provided adjacent the sheet feed cylinder and moveable to a sheet transferring position where the sheet is transferred from the feeder board to the sheet feed cylinder gripper when the sheet feed cylinder gripper reaches a sheet transferring position, the swing mechanism providing a cyclic period for transferring the sheet from the feeder board to the sheet feed cylinder gripper, the cyclic period being substantially equal to a rotation period of a plurality of times of rotation of the sheet feed cylinder, the plurality of times being equal to the number of color regions.

11. An offset printing machine for forming an image on a sheet comprising:

a frame;

a plate cylinder supported by the frame and rotatable about its axis and having an outer peripheral surface equally divided in a circumferential direction into at least two color regions, an ink image being formed on each color region, each color region having an equal circumferential length;

a blanket cylinder supported by the frame and rotatable about its axis and having an outer peripheral surface in contact with the color regions and equally divided in a circumferential direction into at least two color sections, each ink image on each color region being transferred to each color section, and each color section having an equal circumferential length;

an impression cylinder supported by the frame and rotatable about its axis and having an outer peripheral surface on which the sheet is held and transferred, each color section being in contact with the outer peripheral surface of the impression cylinder for transferring each ink image on each color section onto the sheet, the outer peripheral surface of the impression cylinder being equally divided into a plurality of segments each having a peripheral length equal to the circumferential length of the color region and the color section;

impression cylinder grippers provided at the outer peripheral surface of the impression cylinder and movable along with the rotation of the impression cylinder, each impression cylinder gripper being positioned at each leading end portion of each segment, and each impression cylinder gripper being movable between an open position and a closed position;

a sheet discharge mechanism comprising two sprockets rotatable about their axes extending in a direction parallel with the axis of the impression cylinder;

an endless chain mounted on the sprockets and movable by the rotation of the sprockets; and at least two sheet discharge grippers fixed to the endless chain and equidistantly spaced away from each other, each of the discharge grippers being movable between its open position for receiving and releasing a sheet and closed position for holding a sheet, the impression cylinder grippers and the discharge grippers providing a positional relationship that any one of the impression cylinder grippers reaches a discharge position between the impression cylinder and the sheet discharge mechanism when one of the sheet discharge grippers reaches the discharge position;

a sheet discharge side impression cylinder gripper drive mechanism for moving each one of the impression cylinder grippers between its open position and closed position at the sheet discharge position; and a sheet discharge gripper driving mechanism for moving each one of the sheet discharge grippers between its open position and closed position at the sheet discharge position, the at least two sheet discharge grippers and the impression cylinder grippers providing a positional relationship so that one of the impression cylinder grippers is in confrontation with one of the sheet discharge grippers at a predetermined timing occurring at every predetermined number of access of any one of the impression cylinder grippers to the sheet discharge position, the predetermined number being equal to the number of color sections of the blanket cylinder;

the sheet discharge side impression cylinder gripper drive mechanism comprising:

a cam shaft rotatably supported by the frame, and rotated once each time the impression cylinder rotates a predetermined number which is the number of the color sections divided by the number of the segments;

a cam member provided integrally with the cam shaft and rotatable together with the cam shaft, the cam member having a front half first cam surface area and a rear half second cam surface area;

a discharge grip switching cam supported to the frame and movable between an abutment position abuttable on the impression cylinder grippers for moving the impression cylinder grippers from their closed position to their open position when each one of the impression cylinder grippers passes by the sheet discharge position and non-abutment position spaced away from the impression cylinder grippers for maintaining the impression cylinder grippers to their closed position; and a link mechanism having one end in contact with the cam member and movable in accordance with a contour of the cam member and having another end connected to the discharge grip switching cam for moving the discharge grip switching cam between the abutment position and the non-abutment position, the abutment position being provided by the contact of the one end with the first cam surface area, and the non-abutment position being provided by the contact of the one end with the second cam surface area, whereby the closed position of the impression cylinder gripper is maintained when the impression cylinder gripper passes by the sheet discharge position provided that any one of the sheet discharge gripper is positioned offset from the sheet discharge position.

* * * * *